US008511862B2

(12) United States Patent
Ishida et al.

(10) Patent No.: US 8,511,862 B2
(45) Date of Patent: Aug. 20, 2013

(54) OPTICAL UNIT AND LIGHTING APPARATUS

(75) Inventors: Toshiyuki Ishida, Yokosuka (JP); Akimichi Takahashi, Yokosuka (JP); Hirokazu Yamada, Yokosuka (JP); Makoto Kawagoe, Yokosuka (JP); Hiroyuki Kuramochi, Yokosuka (JP)

(73) Assignees: Toshiba Lighting & Technology Corporation, Kanagawa-ken (JP); Kabushiki Kaisha Toshiba, Tokyo (JP)

( * ) Notice: Subject to any disclaimer, the term of this patent is extended or adjusted under 35 U.S.C. 154(b) by 95 days.

(21) Appl. No.: 13/045,831

(22) Filed: Mar. 11, 2011

(65) Prior Publication Data

US 2011/0235334 A1 Sep. 29, 2011

(30) Foreign Application Priority Data

Mar. 29, 2010 (JP) ..... 2010-075518
Oct. 19, 2010 (JP) ..... 2010-234910

(51) Int. Cl.
*F21V 29/00* (2006.01)

(52) U.S. Cl.
USPC ..... 362/294; 313/46

(58) Field of Classification Search
USPC ..... 362/294, 296.01, 297
See application file for complete search history.

(56) References Cited

U.S. PATENT DOCUMENTS 2,332,138 A 10/1943 Epstein
7,414,546 B2 8/2008 Singer
7,434,959 B1 10/2008 Wang
7,506,997 B1 3/2009 Eriksson
2003/0117798 A1 6/2003 Leysath
2003/0156416 A1 8/2003 Stopa
2005/0030752 A1 2/2005 Imai
2005/0225222 A1* 10/2005 Mazzochette et al. ..... 313/46
2007/0070628 A1 3/2007 Chen
2007/0121343 A1 5/2007 Brown
2007/0247856 A1 10/2007 Wang
2008/0002399 A1 1/2008 Villard
2008/0062689 A1 3/2008 Villard
2008/0080188 A1 4/2008 Wang
2008/0080189 A1 4/2008 Wang
2008/0123367 A1 5/2008 Pan
2008/0186695 A1 8/2008 Awai
2009/0086491 A1 4/2009 Ruud
2009/0303715 A1* 12/2009 Takasago et al. ..... 362/235
2010/0002430 A1 1/2010 Liou (Continued)

FOREIGN PATENT DOCUMENTS

CN 2842187 Y 11/2006
CN 1967885 5/2007

(Continued)

OTHER PUBLICATIONS

U.S. Appl. No. 12/473,482.

(Continued)

*Primary Examiner* — Mary Ellen Bowman
(74) *Attorney, Agent, or Firm* — DLA Piper LLP

(57) ABSTRACT

According to one embodiment, an optical unit includes a light emitting module having a light emitting element, a supporting substrate supporting the light emitting module, a reflector controlling distribution of light from the light emitting module, and a heat sink thermally connected to the supporting substrate.

4 Claims, 17 Drawing Sheets

(56) References Cited

U.S. PATENT DOCUMENTS

| | | | | |
|---|---|---|---|---|
| 2010/0053953 | A1 | 3/2010 | Wung | |
| 2010/0118548 | A1* | 5/2010 | Nezu | 362/297 |
| 2010/0142201 | A1 | 6/2010 | Venturini | |
| 2010/0214780 | A1 | 8/2010 | Villard | |
| 2010/0296289 | A1 | 11/2010 | Villard | |
| 2011/0110083 | A1 | 5/2011 | Pahlke | |

FOREIGN PATENT DOCUMENTS

| | | | |
|---|---|---|---|
| CN | 101101096 | A | 1/2008 |
| CN | 101101102 | A | 1/2008 |
| CN | 101174612 | | 5/2008 |
| CN | 201180920 | | 1/2009 |
| CN | 201218482 | | 4/2009 |
| CN | 101603656 | | 12/2009 |
| DE | 202007001148 | | 3/2007 |
| DE | 202007011385 | | 1/2008 |
| DE | 102008007723 | | 8/2009 |
| DE | 102008022414 | | 11/2009 |
| EP | 1916468 | | 4/2008 |
| EP | 2058584 | | 5/2009 |
| EP | 2 133 621 | | 12/2009 |
| EP | 2138758 | | 12/2009 |
| GB | 487122 | | 6/1938 |
| JP | 2003-203506 | | 7/2003 |
| JP | 2004-200102 | | 7/2004 |
| JP | 3694310 | | 6/2006 |
| JP | 2007-165051 | | 6/2007 |
| JP | 2007-242258 | | 9/2007 |
| JP | 3137249 | | 10/2007 |
| JP | 2009-290244 | | 12/2009 |
| WO | WO 2007/088665 | | 8/2007 |
| WO | WO 2009/119929 | | 10/2009 |

OTHER PUBLICATIONS

U.S. Appl. No. 13/169,814.
Extended European Search Report issued in EP 11157901,7 dated Jun. 20, 2012.
English Language Abstract of JP 2009-290244 published Dec. 10, 2009.
English Language Translation of JP 2009-290244 published Dec. 10, 2009.
English Language Abstract of JP 2003-203506 published Jul. 18, 2003.
Enoblish Language Translation of JP 2003-203506 published Jul. 18, 2003.
English Language Abstract of JP 2007-165051 Published Jun. 28, 2007.
English Abstract of JP 2004-200102, published Jul. 15, 2004.
Machine English Language Translation of 2004-200102, published Jul. 15, 2004.
Office Action issued in corresponding application CN 200910146546.8 on Jun. 23, 2010.
English Translation of Office Action issued in corresponding application CN 200910146546.8 on Jun. 23, 2010.
English Language Abstract of CN 101101096A, published Jan. 9, 2008.
English Language Abstract of CN 2842187Y, published Nov. 29, 2006.
English Language Abstract of CN 101101102A, published Jan. 9, 2008.
European Search Report issued in EP 09014067.4 dated Mar. 16, 2010.
English Language Abstract of JP 2007-242258 published Sep. 20, 2007.
English Language Translation of JP 2007-242258 published Sep. 20, 2007.
Chinese Office Action issued in CN 201110057672 on Nov. 14, 2012.
English Language Translation of Chinese Office Action issued in CN 201110057672 on Nov. 14, 2012.
English Language Abstract of CN 201180920 published Jan. 14, 2012.
Chinese Office Action issued in CN201110057675 on Nov. 5, 2012.
English Language Translation of Chinese Office Action issued in CN201110057675 on Nov. 5, 2012.
English Language Abstract of CN101603656 published on Dec. 16, 2009.
English Language Abstract of CN 101174612 published May 7, 2008.
English Language Abstract of CN 1967885 published May 23, 2007.
English Language Abstract of DE 102008022414 published Nov. 19, 2009.
English Language Abstract of CN 201218482 published Apr. 8, 2008.
Extended European Search Report issued in EP 11157892 on Nov. 7, 2012.
U.S. Appl. No. 12/615,753.
U.S. Appl. No. 13/045,812.

* cited by examiner

OPTICAL UNIT AND LIGHTING APPARATUS

CROSS-REFERENCE TO RELATED APPLICATIONS

This application is based upon and claims the benefit of priority from Japanese Patent Applications No. 2010-075518, filed Mar. 29, 2010 and No. 2010-234910, filed Oct. 19, 2010; the entire contents of all of which are incorporated herein by reference.

FIELD

Embodiments describe herein relate generally to an optical unit and to a lighting apparatus that includes a plurality of the optical units as a light source.

BACKGROUND

In recent years, from the viewpoint of energy and maintenance savings, a variety of lighting apparatuses that use a small and lightweight LED that has a high output and a long life span as a light source have been developed.

The aforementioned lighting apparatus is suitable for use as a road lighting or the like. The lighting apparatus has a light source apparatus that includes a plurality of mounts attached to an apparatus main body and a plurality of LED modules attached to the mounts. The light source apparatus is covered by a cover glass attached to the apparatus main body.

An LED that is used as a light source for illumination is a high power diode, and a large quantity of heat is generated by each LED. If the generated heat accumulates in the vicinity of the LED, the heat leads to a decrease in the optical output of the LED or a deterioration in the life span characteristics thereof or the like.

According to the optical unit, since a light source apparatus that is equipped with a plurality of LEDs is arranged inside an enclosed space on which a cover glass is provided in the apparatus main body, the generated heat by the plurality of LEDs is liable to be confined within the enclosed space.

Consequently, there is the problem that the heat dissipation properties of each LED are low, and this situation is liable to lead to a decrease in the optical output of the LEDs and a deterioration in the life span characteristics thereof. Further, since a plurality of LED modules are directly attached to a mount that is fixed to the apparatus main body, if, for example, a malfunction occurs in one part of an LED module, it is not possible to replace only the LED module in which the malfunction occurs, and the entire lighting apparatus must be replaced. Hence, there is also the problem that the configuration leads to an increase in maintenance costs.

BRIEF DESCRIPTION OF THE DRAWINGS

FIG. 2 is viewed from the front of an irradiation opening thereof;

DETAILED DESCRIPTION

Figure 1:
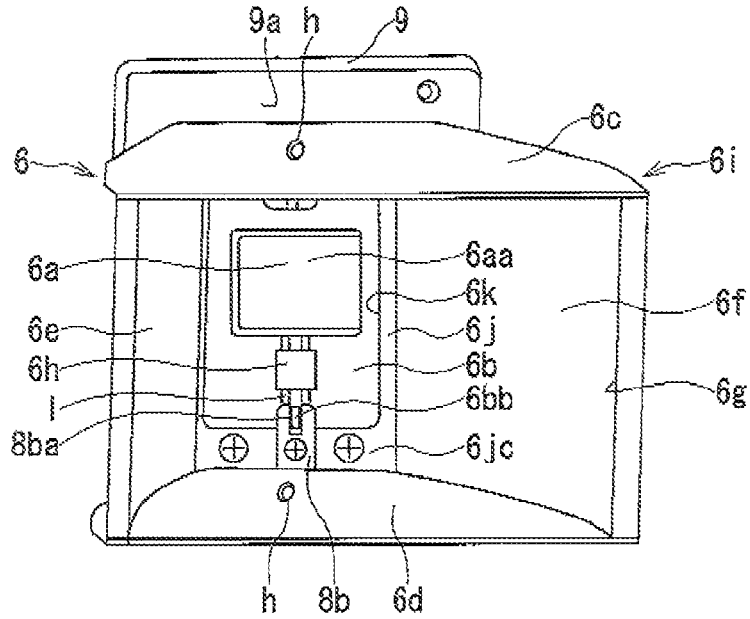
FIG. 1 is a perspective view when an LED optical unit according to a first embodiment of the present invention is viewed from a front side of an irradiation opening thereof.

An invention according to a first aspect of the present application is an optical unit including a light emitting module having a light emitting element, a supporting substrate supporting the light emitting module, a reflector controlling distribution of light from the light emitting module, and a heat sink thermally connected to the supporting.

According to the invention of the present and subsequent aspects, a light emitting element that employs a semiconductor as a light emitting source, such as a light emitting diode (LED) or a semiconductor laser, can be used as a light emitting element of the optical unit. In the case of using an LED, for example, a COB (Chip-on-Board) type LED or SMD type LED can be favorably used. The number of light emitting elements and the number of optical units can be arbitrarily selected. A plurality of optical units may have the same functions and performance or may have different functions and performance.

For example, the supporting substrate comprises a flat plate made of a ceramic material with a high thermal conductivity having electrical insulation properties or the like. An LED module of the light emitting module is arranged on the flat plate in a state in which a light emitting surface thereof is exposed to outside.

For example, a plurality of heat dissipation fins or the like are used as a heat sink. The heat sink can be directly attached to a rear surface of a unit supporting portion, or can be integrally formed with the unit supporting portion. In short, it is sufficient that the heat sink is arranged on another surface side of the unit supporting portion to which the supporting substrate is attached so as to enable effective dissipation of heat from the light emitting module.

According to a second aspect of an optical unit, the supporting substrate made of a ceramic material, and is sandwiched by a pressing member that elastically presses against a surface of the supporting substrate and a unit supporting portion.

The pressing member, for example, comprises a pair of plate springs or the like having elasticity and are attached to a supporting substrate comprising a flat plate made of a ceramic material or the like. Each pressing member is arranged, for example, at an upper side and a lower side facing each other in the vertical direction of a pair of opposing sides of the supporting substrate.

According to one embodiment, a lighting apparatus includes a plurality of optical units according to the first or second aspect; and a main body providing the plural optical units.

Although preferably, for example, the body comprises a metal such as die-cast aluminum or a synthetic resin that does not transmit light or the like, and blocks light, a material from which light leaks to a certain degree is acceptable within a range that does not constitute an optical obstruction. A support plate of the optical unit may be formed with a metal or a synthetic resin. If the light emitting element is an LED, it is preferable to adopt a configuration that promotes the dissipation of heat of the LED by forming the support plate with a metal comprising die-cast aluminum or the like, and mounting the LED thereto in a manner that enables thermal conduction.

Although the lighting apparatus of one embodiment is favorably used as an outdoor lighting apparatus such as a road light of an ordinary road or a highway or the like, or as a security light that illuminates an outdoor area such as a park, the lighting apparatus can also be used as an indoor lighting fitting installed in a location that requires a predetermined brightness in a longitudinal direction (direction in which a passageway or the like extends) such as an indoor corridor or passageway. For example, when using the lighting apparatus as a security light, it is preferable to emit light from both sides in the width direction of the body in a diagonally downward direction so as to obtain a light distribution over a wide area along the longitudinal direction of the road.

Hereunder, embodiments of the present invention will be described based on the drawings. Note that, in the drawings, the same or corresponding portions are denoted by the same reference numerals.

Figure 3:
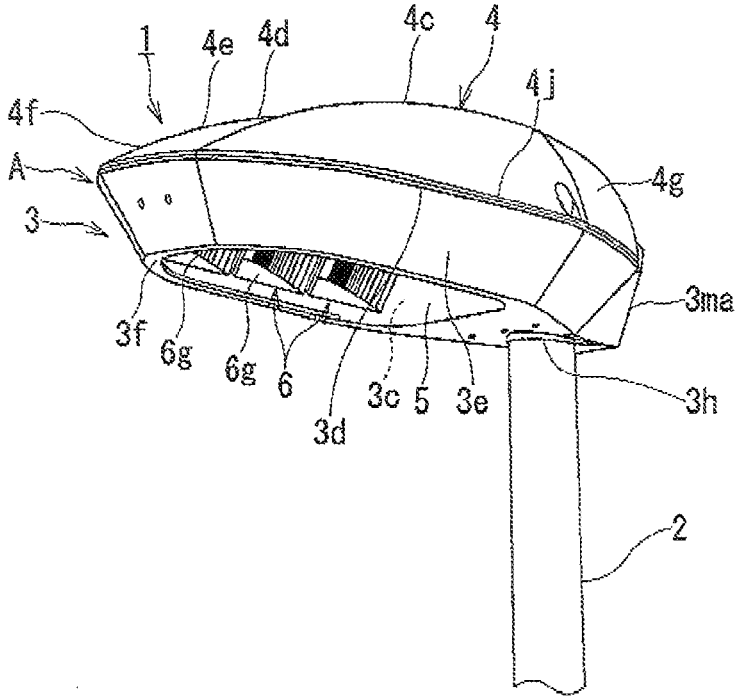
FIG. 3 is an external perspective view when a state in which a lighting apparatus is arranged on a support column is viewed from underneath.
Figure 4:
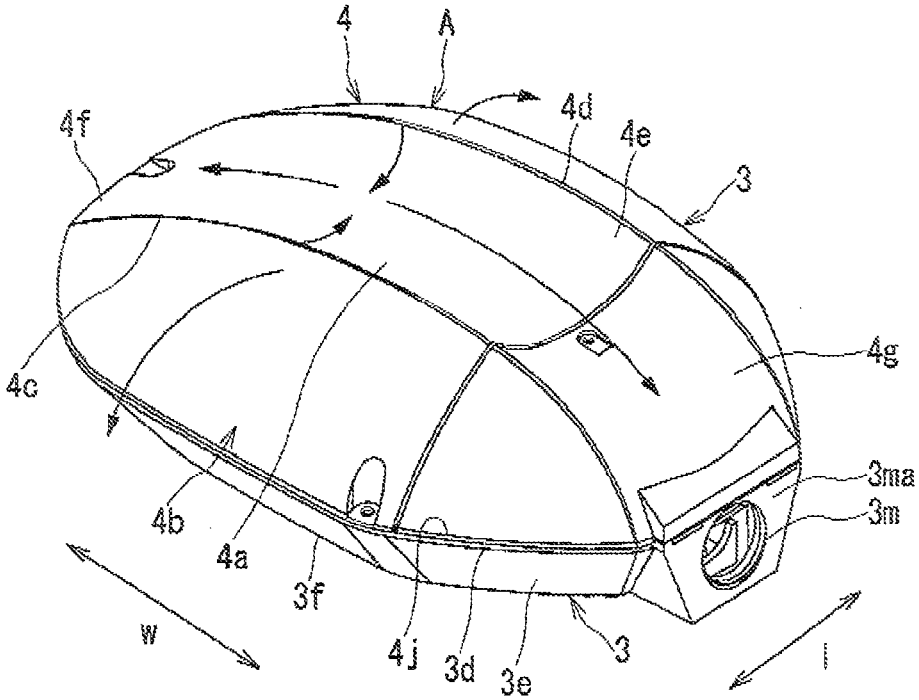
FIG. 4 is an external perspective view when the lighting apparatus shown in FIG. 3 is viewed from overhead.
Figure 5:
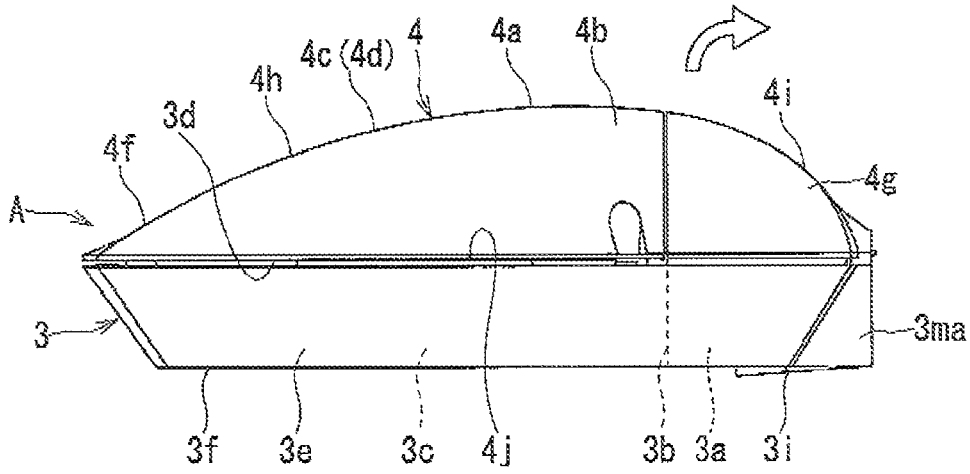
FIG. 5 is a front view of the lighting apparatus.
Figure 6:
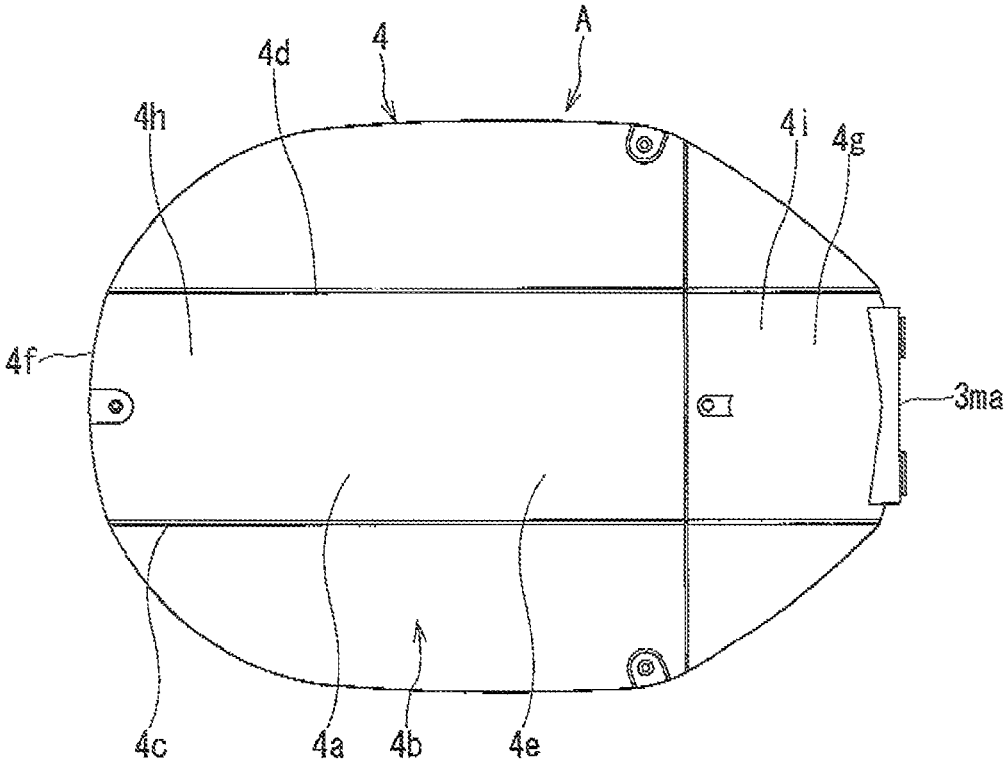
FIG. 6 is a plan view of the lighting apparatus.
Figure 7:
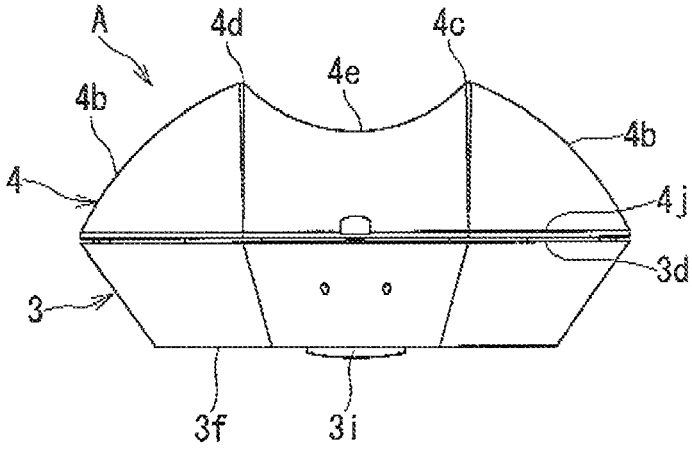
FIG. 7 is a left side view of the lighting apparatus.

As shown in FIG. 3 to FIG. 6, a lighting apparatus 1 according to the present invention can be used, for example, as a road lighting or the like on a road such as a highway or an ordinary road. Hence, a case is described hereunder in which the lighting apparatus 1 is applied to a road light. As shown in FIG. 3, the lighting apparatus 1 is arranged at, for example, a height of approximately 10 meters above ground by a pole 2 being a hollow circular column or a hollow angular column or the like as a support column. The pole 2, for example, is firmly erected above the ground at the outer side of an edge in the width direction of a road such as a highway, and a plurality of the poles 2 are erected at a required pitch in the longitudinal direction of the road. As shown in FIG. 4 to FIG. 6, the lighting apparatus 1 has an apparatus main body A. The apparatus main body A includes a case main body 3 and a top cover 4 as one example of a cover. The case main body 3 and the top cover 4 are fixed by screw clamp or the like.

As shown in FIG. 4, a planar shape of the top cover 4 is formed in an approximately oblong shape by, for example, a die-cast aluminum material. The top cover 4 is formed so that a length W thereof along a width direction (the left-to-right direction in FIG. 5 and FIG. 6) of a road (not shown in the drawings) as one example of an illumination object is longer than a length 1 along a longitudinal direction (vertical direction in FIG. 5 and FIG. 6) of the road.

As shown in FIG. 4 to FIG. 8, the upper surface of the top cover 4 is formed as a curved surface 4*b* which protrudes outward in a manner in which an approximately center section thereof is an apex 4*a*. In the curved surface 4*b*, a pair of projecting portions 4*c* and 4*d* at the front and rear of an outward convexity are integrally formed in the longitudinal direction of the top cover 4.

The projecting portions 4*c* and 4*d* are arranged in an approximately parallel condition with a required space therebetween in the width direction of the top cover 4. A band-shaped concave portion 4*e* that is recessed in the shape of a concave are on the inner side and that is lower than the projecting portions 4*c* and 4*d* is integrally formed between the projecting portions 4*c* and 4*d*.

The concave arc-shaped concave portion 4*e* is integrally coupled to a front end portion (left end portion in FIG. 5 and FIG. 6) 4*f* and a rear end portion (right end portion in FIG. 5 and FIG. 6) 4*g* by downward inclined planes 4*h* and 4*i*. The downward inclined planes 4*h* and 4*i* are formed as upwardly convex curved surfaces that gradually descend from the center section 4*a* of the top cover 4 towards the front end portion 4*f* and the rear end portion 4*g*, respectively. More specifically, the outer surface of the top cover 4 is formed in a streamline shape that reduces air resistance when external air flows in the longitudinal direction and the width direction as shown by the arrows in FIG. 4.

As shown in FIG. 5, the rear end of the rear end portion 4*g* of the top cover 4 is rotatably attached to an upper end portion of the rear end (right end in FIG. 5) of the case main body 3. Thus, the top cover 4 is formed as an opening/closing cover that can open and close in the direction of the white arrow in FIG. 5.

An electricity chamber 3*a* is formed inside the rear end of the case main body 3 below the opening/closing cover 4*g* in FIG. 4. The electricity chamber 3*a* is partitioned from a light source chamber 3*c*, described later, by a partitioning wall 3*b* indicated by a dashed line in FIG. 5. A power source terminal (not shown), a power source line connected to the power source terminal, and one end of a lighting control line are housed in the electricity chamber 3*a* in a watertight manner.

Figure 8:
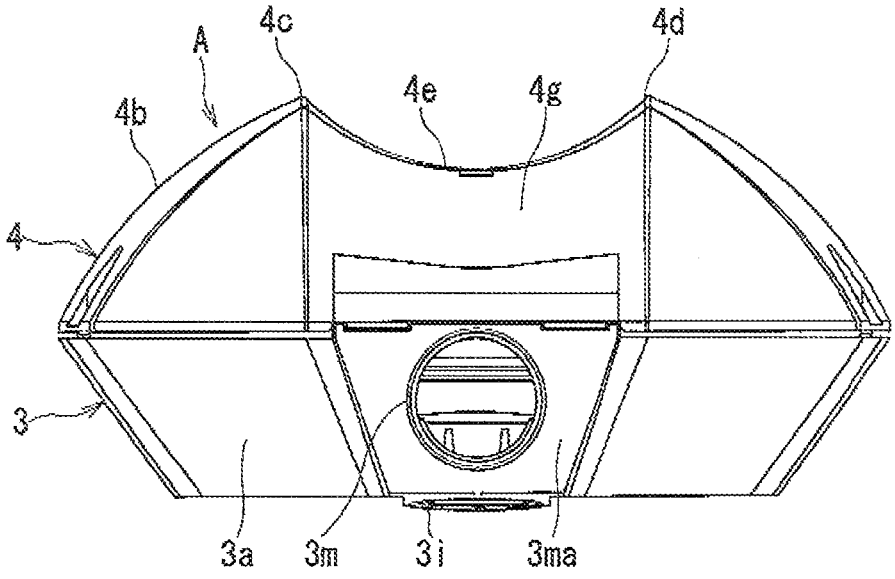
FIG. 8 is a right side view of the lighting apparatus.
Figure 14:
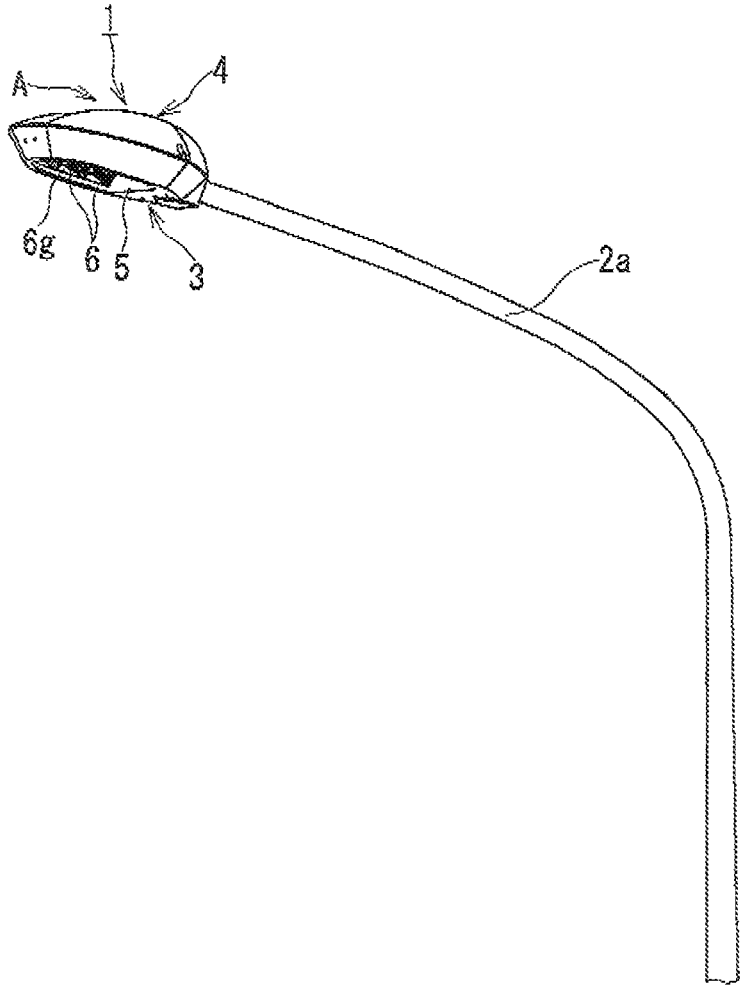
FIG. 14 is an elevated perspective view of a lighting apparatus arranged on a curved pole.

As shown in FIG. 8, the right end wall in FIG. 5 and FIG. 6 of the case main body 3 that is the right end wall in FIG. 4 of the electricity chamber 3*a* forms a pole coupling portion 3*ga*. The pole coupling portion 3*ga* has a lateral hole for pole insertion 3*g* into which a distal end portion of a curved pole 2*a* shown in FIG. 14 is inserted and fixed.

As shown in FIG. 3, the case main body 3 that has a polygonal cylindrical shape in which an opening is formed in the upper and lower ends is detachably coupled by screwing to a lower end 4*j* of an opening of the top cover 4. The case main body 3 has an upper end portion 3*d* coupled with the top cover 4. A planar shape of the upper end portion 3*d* is formed in a polygonal, flat cylindrical shape formed in an approximately oblong form that is the same form and same size as the oblong form of the planar shape of the top cover 4.

Further, a side surface 3*e* is formed in an inclined plane that gradually narrows from the upper end portion 3*d* towards the lower end 3*f*. A large opening portion (not shown) passing through almost the entire surface of the upper end in the drawings of the light source chamber 3*c* is formed in the upper end portion 3*d* of the case main body 3.

Figure 9:
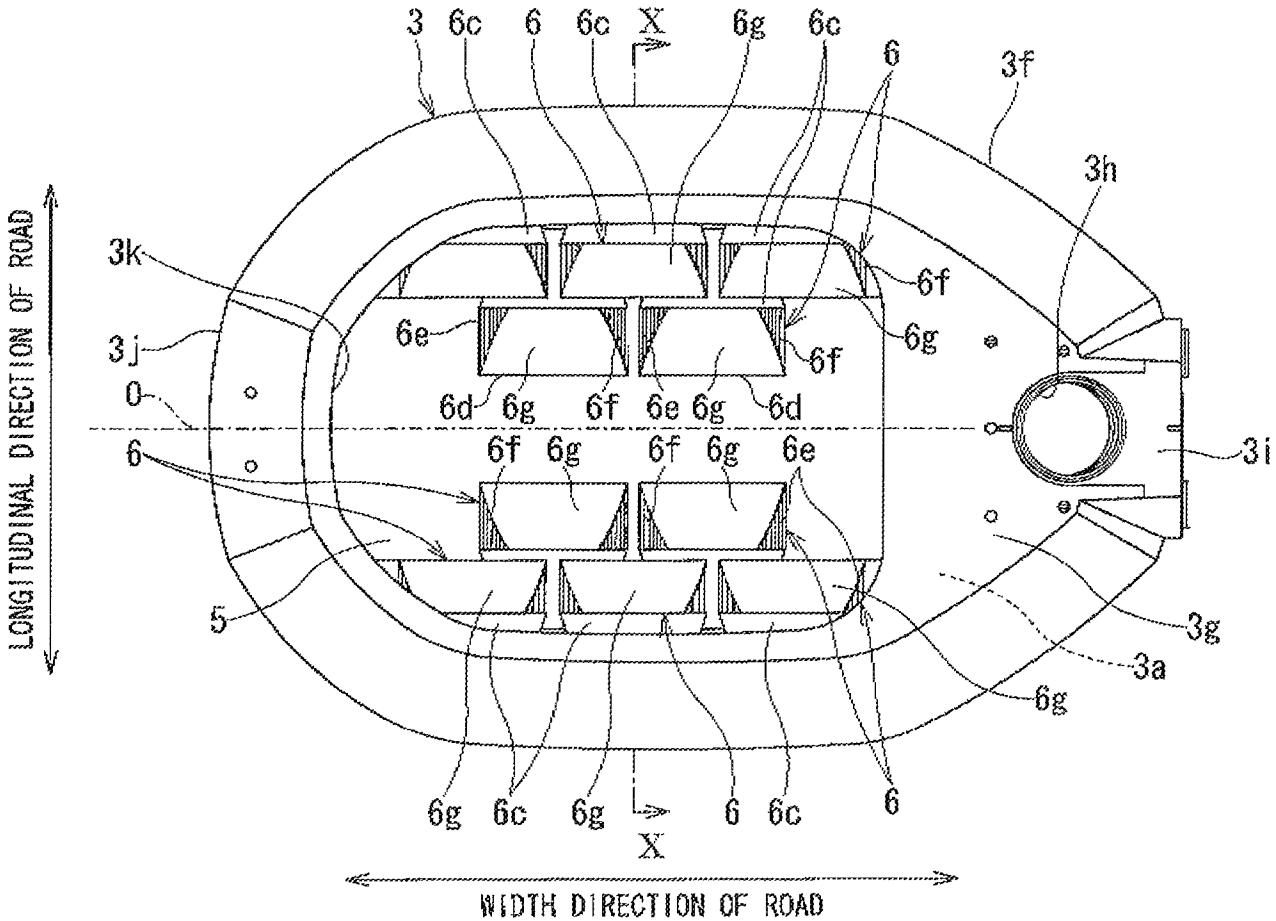
FIG. 9 is a bottom view of the lighting apparatus.

FIG. 9 is a bottom view of the lower end 3*f* of the case main body 3. The case main body 3 has a pole coupling portion 3*j* formed in the lower end portion 3*f* of a rear end portion 3*h* on the electricity chamber 3*a* side thereof. The pole coupling portion 3*j* has a vertical hole for pole insertion 3*i* into which, for example, a distal end portion of the pole 2 having a straight bar shape shown in FIG. 3 is inserted and fixed. A polygonal opening 3*l* having a shape of a horizontally-long rectangle in which each corner portion has been chamfered is formed on a front end portion (left end in FIG. 9) 3*k* side of the case main body 3. A translucent plate 5 comprising tempered glass as one example of a translucent body is arranged in the opening 3*l* to form an illumination portion, and seal the light source chamber 3*c* in a watertight and airtight manner.

A plurality of LED optical units 6, 6, . . . as one example of an optical unit are aligned in a plurality of rows, for example, in FIG. 9, four horizontal rows, and housed inside the light source chamber 3*c*.

A required number, for example, five, of the LED optical units 6, 6, . . . are symmetrically arranged on the left and right sides (top and bottom in FIG. 9), respectively, taking a central axis O passing through the center of the four rows in the front-to-rear direction (the left-to-right direction in FIG. 9) of the case main body 3 as an axis of symmetry.

The five LED optical units 6, 6, . . . on each side may be arranged so that a required number, for example, two, of the LED optical units 6, 6, . . . are arranged in parallel in the axial direction of the central axis O on an inner side "in" (central axis O side) of the array, and a required number, for example, three, of the LED optical units 6, 6, . . . are arranged in parallel in the axial direction of the central axis O on an outer side "out" thereof.

The LED optical units 6, 6, . . . arranged on the left and right sides have the irradiation openings 6*g*, 6*g*, . . . . The irradiation openings 6*g*, 6*g*, . . . are disposed so as to cross with respect to each other towards the opposite sides in the left-to-right direction, and the respective irradiation lights from the LED optical units 6, 6, . . . intersect below the LED optical units 6, 6, . . . .

Figure 10:
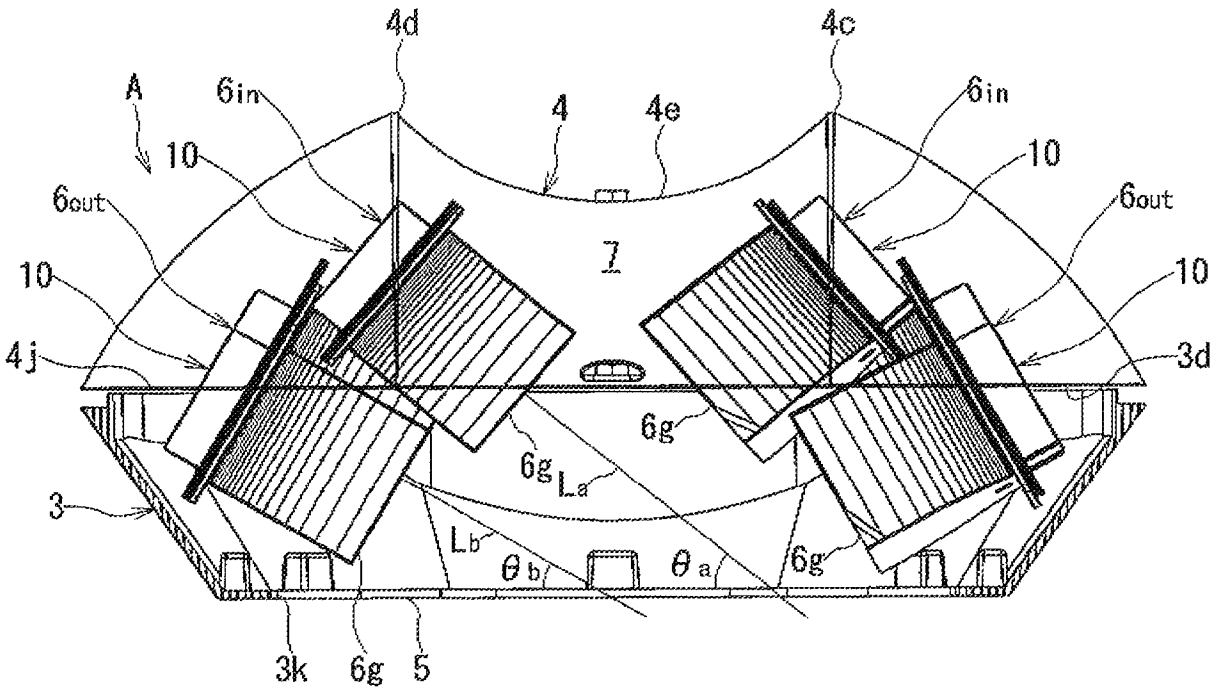
FIG. 10 is a schematic sectional view along a line X-X in FIG. 9.

As shown in FIG. 10, a light source housing portion 7 forms an inner space of the apparatus main body A housing a plurality of the LED optical units 6, 6, . . . . Inside the light source housing portion 7, each LED optical unit 6in is disposed above, that is, at a higher position than, each LED optical unit 6out. The inner side and outer side LED optical units 6in and 6out arranged on the left and right in FIG. 10 are aligned in a truncated chevron shape that expands like a folding fan in the downward direction in the drawings, and are aligned in an intersecting truncated chevron shape.

In order to irradiate light in the proximity of the lighting apparatus 1, each LED optical unit 6in is fixed in an inclined state so that a light axis La of the irradiation light is at a required angle θa (for example, 50°) with respect to the upper surface in FIG. 10 of the translucent plate 5. Further, in order to irradiate light to an area farther away than the proximity of the lighting apparatus 1, each LED optical unit 6out is fixed in an inclined state so that a light axis Lb of the irradiation light is at a required angle θb (for example, 60°) with respect to the upper surface in FIG. 10 of the translucent plate 5.

Figure 11:
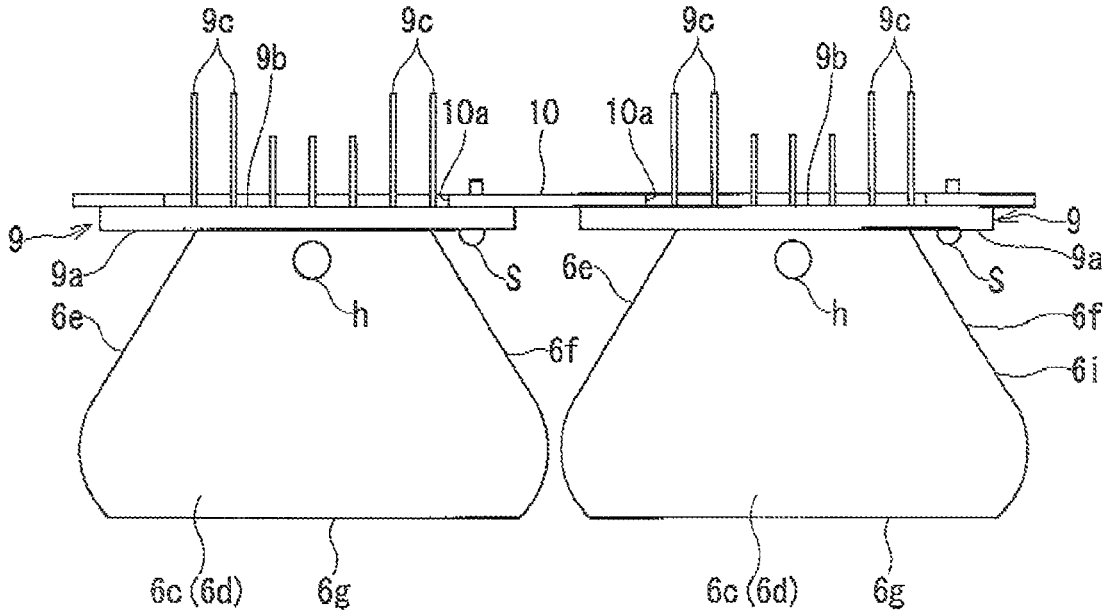
FIG. 11 is a plan view when two of the LED optical units shown in FIG. 1 and FIG. 2 are arranged side by side on a unit mounting plate.
Figure 12:
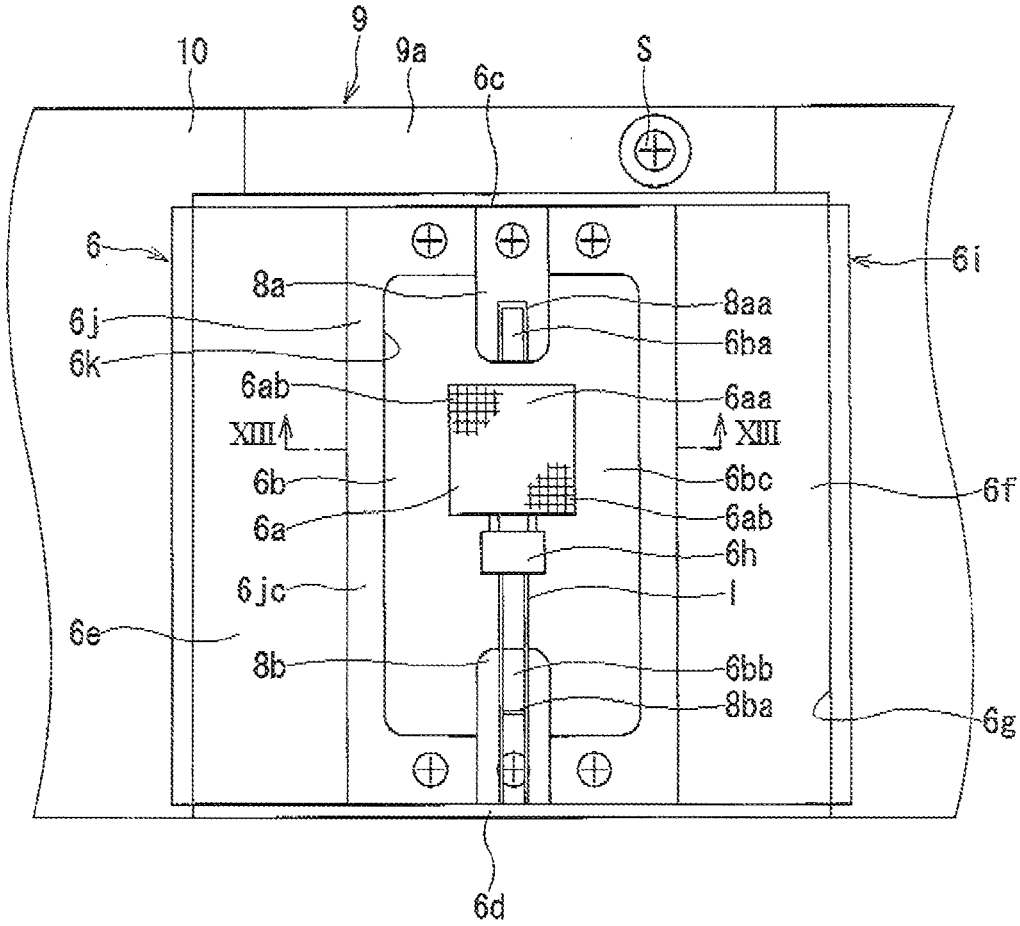
FIG. 12 is a front view when an LED optical unit shown in FIG. 1
Figure 13:
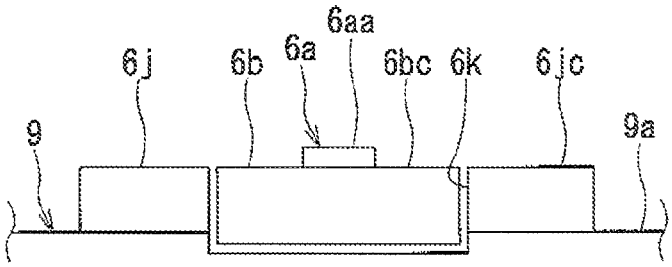
FIG. 13 is a schematic end view of a cross section along a line XIII-XIII shown in FIG. 12.

As shown in FIGS. 11 to 13, each LED optical unit 6 has an LED (light emitting diode) module 6*a*, a ceramic substrate 6*b* as an example of a supporting substrate thereof, an upper and lower pair of flat mirrors 6*c* and 6*d*, a left and right pair of side curved mirrors 6*e* and 6*f*, and a reflecting tube 6*i* constructed as a trumpet-shaped angular cylindrical body in which the four mirrors 6*c* to 6*f* are unified or joined in an integrated manner. The reflecting tube 6*i* has a rectangular irradiation opening 6*g* that expands in a trumpet shape, and a bottom portion 6*j* whose diameter contracts in a trumpet shape on the opposite side in the axial direction thereof.

As shown in FIG. 12, the LED module 6*a*, for example, includes a COB (chip on board) type pseudo-white (blue yellow system) LED bare chip 6*ab* as a light emitting element. More specifically, the LED module 6*a* includes a required number (for example, 196) of LED bare chips 6*ab* emitting blue light. The LED bare chips 6*ab* are directly mounted on a printed circuit board on which a circuit is formed, and arranged in a plurality of rows (14 rows, for example) and a plurality of columns (14 columns, for example). Subsequently, a resin containing phosphors emitting yellow light is applied onto the LED bare chips 6*ab*, the resulting structure is sealed by a silicone resin, and then adhered, for example, by a silicone resin on a substrate.

More specifically, as shown in FIG. 13, the LED module 6*a* is adhered to an approximately center section of the ceramic substrate 6*b* at a front face thereof by a silicone resin that is an adhesive agent, in a state in which a light emitting surface 6*aa* thereof is caused to protrude frontward to some extent. The light emitting surface 6*aa* protrudes somewhat more forward than the front surface of the white ceramic substrate 6*b* in this state.

With respect to the reflecting tube 6*i* shown in FIG. 12, the left and right pair of side curved mirrors 6*e* and 6*f* are formed, for example, by curvedly forming a flat plate of aluminum or the like at a required angle and then forming the inner surface thereof as a reflective surface such as a mirror surface. Further, the curved reflective surface is formed so as to gradually expand towards both sides in the width direction of the road that is the illumination object. Thus, the reflecting tube 6*i* mainly controls the light distribution of light irradiated from the LED module 6*a* in the width direction of the road. More specifically, each of the LED optical units 6, 6, . . . mainly controls the light distribution characteristics in the road width direction along the axial direction of the central axis O as shown in FIG. 9. In this connection, portions represented by a plurality of parallel vertical lines of each of the side curved mirrors 6*e* and 6*f* in FIG. 9 indicate the respective curved inner surfaces (that is, the reflective surfaces) of each of the side curved mirrors 6*e* and 6*f*.

The upper and lower pair of flat mirrors 6*c* and 6*d* made of aluminum in the reflecting tube 6*i* are joined in an integrated manner to the left and right pair of side curved mirrors 6*e* and 6*f* as shown in FIG. 11 and FIG. 12 to thereby form the reflecting tube 6*i* as a bottomed, trumpet-shaped angular cylindrical body that gradually expands towards an illumination opening 6*g*. As shown in FIG. 1 and FIG. 12, the trumpet-shaped reflecting tube 6*i* forms a fitting opening portion 6*k* that interfits with the ceramic substrate 6*b* on a center section of a bottom portion 6*j* on the contracted diameter side of the reflecting tube 6*i*. The ceramic substrate 6*b* is accommodated inside the fitting opening portion 6*k*. When the ceramic substrate 6*b* is accommodated therein, as shown in FIG. 13, a front face 6*bc* of the ceramic substrate 6*b* is approximately flush with an inner surface 6*jc* of the bottom portion 6*j* of the reflecting tube 6*i*. A reflective surface such as a mirror surface is formed on the inner surface of the upper and lower pair of flat mirrors 6*c* and 6*d*, and the pair of flat mirrors 6*c* and 6*d* are arranged side by side in an approximately parallel manner with a required clearance therebetween in the vertical direction in the FIG. 12. Hence, the upper and lower pair of flat mirrors 6*c* and 6*d* do not control light irradiated to outside from the irradiation opening 6*g* so as to magnify the irradiated light. Further, as shown in FIG. 11, heat dissipation holes h and h are formed in the vicinity of the LED module 6*a* in the upper and lower pair of flat mirrors 6*c* and 6*d*, respectively.

The flat and side mirrors 6*c* to 6*f* converge primary reflected light at a height of approximately 7 meters above ground when the apparatus main body A is arranged at a height of approximately 10 meters above ground by means of the pole 2.

The fitting opening portion 6*k* is formed on a front face 9*a* of a unit support plate 9 as unit supporting portion that is formed in the shape of a metal rectangular flat plate made of aluminum or the like, as shown in FIG. 11 and FIG. 12. In a state in which the back surface of the ceramic substrate 6*b* is arranged inside the fitting opening portion 6*k*, the front face of the ceramic substrate 6*b* is elastically supported by an upper and lower pair of plate springs 8*a* and 8*b* as an example of a pressing member screwed into the unit support plate 9. More specifically, the ceramic substrate 6*b* is elastically sandwiched in the thickness direction by the upper and lower pair of plate springs 8*a* and 8*b* and the unit support plate 9.

The upper end and lower end of the plate springs 8*a* and 8*b* screwed into the upper and lower ends of the bottom portion 6*j*, respectively, to thereby fix the plate springs 8*a* and 8*b* thereto. Each distal end portion of the plate springs 8*a* and 8*b* protrudes over the front face of the ceramic substrate 6*b*. Slits 8*aa* and 8*ba* that open at a distal end and extend in the vertical direction in the FIG. 12 are formed in the protruding distal end portions, respectively. Small engagement protrusions 6*ba* and 6*bb* formed in a vertically long rectangular shape are provided in a protruding condition at the upper end and lower end of the front face of the ceramic substrate 6*b*, respectively. By inserting the small engagement protrusions 6*ba* and 6*bb* into the slits 8*aa* and 8*ba*, the ceramic substrate 6*b* is supported with a certain degree of loose. A power supply connector 6*h* is electrically and detachably connected to the LED module 6*a*. The connector 6*h* is electrically connected to a power source terminal inside the electricity chamber 3*a* by a lead wire 1 (a part of the lead wire 1 is not shown in FIG. 1).

Figure 2:
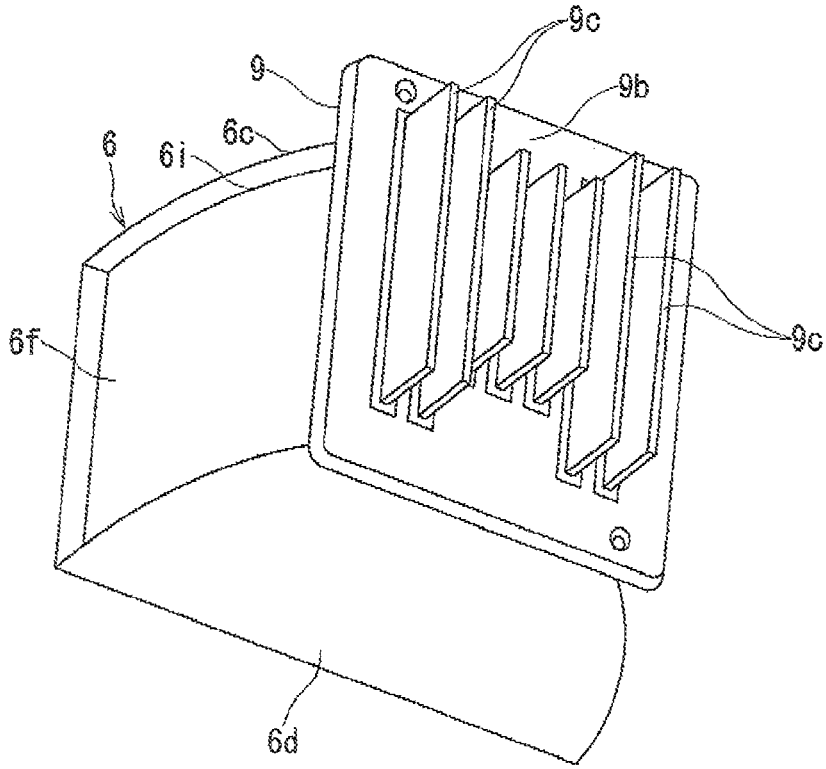
FIG. 2 is a perspective view when the LED optical unit according to the first embodiment of the present invention is viewed from the rear.

As shown in FIG. 1 and FIG. 2, a plurality of heat dissipation fins 9*c*, 9*c*, . . . made of a metal such as aluminum are integrally formed as one example of a heat sink on a back face 9*b* of the unit support plate 9. The plurality of heat dissipation fins 9*c*, 9*c*, . . . are thermally connected to the ceramic substrate 6*b* (the supporting substrate). The outward protruding length of the heat dissipation fins 9*c*, 9*c*, . . . may be the same as each other or, as shown in FIG. 2 and FIG. 11, the outward protruding length of several of the heat dissipation fins 9*c*, 9*c*, . . . on the inner side in the parallel arrangement direction may be shorter than the outward protruding length of the heat dissipation fins 9*c*, 9*c*, . . . on the outer side.

As shown in FIG. 11, a plurality of the LED optical units 6 constructed in this manner are detachably attached by bolts or screws S or the like to a unit mounting plate 10 formed in a band-plate shape.

More specifically, a rectangular insertion hole 10*a* through which the plurality of heat dissipation fins 9*c*, 9*c*, . . . are inserted is formed in the plate thickness direction of the unit mounting plate 10. The support plate 9 of the LED optical unit 6 is detachably fixed by a screw S to the unit mounting plate 10 in a state in which the plurality of heat dissipation fins 9*c*, 9*c*, . . . are inserted through the insertion hole 10*a*. On the unit mounting plates 10, for example, two of the inner side LED optical units 6in are arranged side by side and, for example, three of the outer side LED optical units 6out are arranged side by side. The unit mounting plates 10 are fixed at required places on the inner surface of the top cover 4. More specifically, all of the LED optical units 6, 6, . . . are detachably fixed to the inner surface of the top cover 4. At the time of fixing, at least one part of the unit support plate 9 is brought in contact directly with the inner surface of the top cover 4 or is brought in contact with the inner surface of the top cover 4 through a heat dissipating body such as a metal plate with excellent heat dissipation properties or a heat pipe to thereby enhance the heat dissipation properties of the lighting apparatus 1.

A plurality of power source systems, for example, two power source systems, are provided at a part of the LED optical units 6, 6, . . . . The power source systems are electrically connected to the LED optical units 6, 6, . . . so that, for example, when a malfunction such as non-lighting occurs, it is possible to ensure bilateral symmetry when taking the central axis O of the remaining LED optical units 6, 6, . . . that are irradiating light as the axis of symmetry.

Consequently, even if one of the power source systems is cut off due to some cause, the LED optical units 6, 6, . . . can be turned on to irradiate light by the remaining power source system, or if the LED optical units 6, 6, . . . are already irradiating light, that lighting can be maintained.

The plurality of power source systems may also be connected to the LED optical units 6, 6, . . . so as to maintain the bilateral symmetry of the lighting of the LED optical units 6, 6, . . . around the central axis O as the axis of symmetry.

For example, when two power source systems are provided, and one of the power source systems may be connected to, each of the four inner side LED optical units 6in, 6in, . . . , and the other power source system may be connected to each of the six inner side LED optical units 6out, 6out, . . . . According to this configuration, even if one of the power source systems is cut off, either one of the inner side and outer side LED optical units 6in, 6out, . . . can be caused to irradiate light and, furthermore, the bilateral symmetry can be maintained when irradiating light.

The power source lines of the plurality of systems are connected to a secondary side of a power source terminal block inside the electricity chamber 3*a*. An unshown primary-side power source line is electrically connected to the primary side of the power source terminal bock. The primary side power source line is passed through the inside of the hollow pole 2 and electrically connected to an unshown power supply apparatus. The power supply apparatus includes a control apparatus (not shown) that controls a lighting circuit of the LED optical units 6, 6, . . . to control the lighting. The power supply apparatus is housed inside an unshown box-shaped case, and is mounted on the outer surface of the pole 2 at a height above ground level that allows a worker to easily perform operations relating to the power supply apparatus above ground level.

Next, the action of the lighting apparatus 1 will be described.

When the LED modules 6*a* of the LED optical units 6, 6, . . . are supplied with electricity from the power source lines of a plurality of power source systems, each LED module 6*a*, for example, emits white light. The white light is reflected by the upper and lower pair of flat mirrors 6*c* and 6*d* and the right and left pair of side mirrors 6*e* and 6*f* and is irradiated to the translucent plate 5 side from the irradiation opening 6*g*. The white light is transmitted through the translucent plate 5 and is irradiated onto the road as the illumination object. As shown in FIG. 10, the respective lights from the LED optical units 6, 6, . . . disposed on the left and right sides intersect below the LED optical units 6, 6, . . . .

Since the upper and lower pair of flat mirrors 6*c* and 6*d* are arranged approximately parallel to each other, the light reflected by the upper and lower pair of flat mirrors 6*c* and 6*d* is irradiated mainly in the longitudinal direction of the road substantially without spreading. In contrast, since the side curved mirrors 6*e* and 6*f* expand in the width direction of the road, the white light reflected by the right and left pair of side curved mirrors 6*e* and 6*f* is mainly irradiated in the width direction of the road. Accordingly, the illuminating angle at which light is irradiated in the width direction of the road can be controlled by means of the expanding angle of the left and right pair of side curved mirrors 6*e* and 6*f*.

More specifically, since the lighting apparatus 1 can control an illuminating angle in the width direction of the road for each LED optical unit 6, leaking light can be reduced by appropriately controlling the distribution of light in the width direction of the road that is leaking light for each LED optical unit 6. Thus, the rate of illumination with respect to an area to be illuminated can be improved and a target illuminance can be obtained with low power.

Further, by appropriately adjusting the shape or expanding angle of the side curved mirrors 6*e* and 6*f*, primary reflected light reflected by the side curved mirrors 6*e* and 6*f* can be caused to converge within the width of the road. In addition, when the height of the lighting apparatus 1 above ground is arranged at, for example, a height of ten meters above ground by means of the height of the pole 2, the primary reflected light can also be caused to converge inside a range of a height of seven meters above ground.

Furthermore, the irradiation points in the road width direction of the plurality of LED optical units 6, 6, . . . can be made the same, and the irradiating directions can be allocated so as to obtain an equal distribution of brightness in the longitudinal direction of the road.

As shown in FIG. 10, since the lighting apparatus 1 includes both the inner side LED optical units 6in, 6in, . . . for proximate radiation and the LED optical units 6out, 6out, . . . for distant radiation to an area farther away than the proximity of the lighting apparatus 1, both the proximity of the lighting apparatus 1 and an area at a farther distance than the proximity of the lighting apparatus 1 can be illuminated. Moreover, as shown in FIG. 9, the lighting apparatus 1 includes two sets of the LED optical units 6, 6, . . . in which each set contains LED optical units 6, 6, . . . for proximate radiation and for distant radiation that are respectively arranged on the left and right (top and bottom in FIG. 9) of the axis of symmetry (central axis O). Furthermore, the two sets are symmetrically arranged on the left and right and, as shown in FIG. 10, the sets are arranged so as to be facing in an inclined manner in a truncated chevron shape with respect to the translucent plate 5 of the irradiating portion. Hence, the distribution of light irradiated to outside from the translucent plate 5 can be spread in a truncated chevron shape to expand the illumination region, and the lights irradiated from the right and left sides are caused to intersect (cross) in the proximity of the underneath of the translucent plate 5. Consequently, the brightness of the irradiation in the proximity of the lighting apparatus 1 can be improved.

Furthermore, since the LED optical units 6in, 6in, . . . for proximate radiation are arranged above, that is, on an upper level with respect to, the LED optical units 6out, 6out, . . . for distant radiation, the LED optical units 6in, 6in, . . . are heated by heat dissipated from the LED optical units 6out, 6out, . . . . Consequently, the LED optical units 6in, 6in, . . . are liable to be heated to a higher temperature than the outer side LED optical units 6out, 6out, and the optical output thereof is liable to decrease. However, because the LED optical units 6in, 6in, . . . for proximate radiation are used for illumination in the proximity of the lighting apparatus 1, the influence of such a decrease in optical output is small. Moreover, since the respective lights irradiated from the LED optical units 6, 6, . . . arranged on the left and right intersect, the brightness in the proximity of the lighting apparatus 1 is originally strong. Therefore, even if the optical output of the LED module 6*a* of the LED optical units 6in, 6in, . . . decreases due to an increase in temperature, the influence of a decrease in the irradiation light in the proximity of the lighting apparatus 1 is even less.

In contrast, since the LED optical units 6out, 6out, . . . from which a high optical output is required are position below the LED optical units 6in, 6in, . . . , the degree to which the LED optical units 6out, 6out, . . . are heated by heat dissipated from the LED optical units 6in, 6in, . . . is low. Consequently, a decrease in the optical output thereof due to an increase in temperature can be suppressed to a low level.

Further, as shown in FIG. 9, in the LED optical units 6, 6, . . . , the upper and lower pair of flat mirrors 6*c* and 6*d* are arranged side by side so as to be adjacent in the longitudinal direction of the road. Hence, it is possible to expand the length in the longitudinal direction of the distribution of light thereof that is irradiated in the longitudinal direction of the road.

In addition, since the LED optical units 6in, 6in, . . . and the LED optical units 6out, 6out, . . . are arranged in two upper and lower levels, it is possible to decrease the size of the planar shape of the case main body 3 and the top cover 4 that house the LED optical units. Further, since a small and light LED having a high output is used as a light source, the LED optical units can be made smaller, lighter and with a higher output by a corresponding amount.

Furthermore, if rain, snow, dirt, dust, dead leaves or the like fall onto the upper surface of the top cover 4, they are caused to slip off from the upper surface by the downward curved surface in the front-to-rear direction or the downward curved surface in the width direction of the top cover 4 as shown by the arrows in FIG. 4. Hence, the accumulation of rain, snow, dirt, dust, dead leaves or the like on the upper surface of the top cover 4 can be reduced. As a result, maintenance can be reduced.

In addition, since the surface area of the top cover 4 is increased by formation thereon of the pair of mountain-like protrusions 4*c* and 4*d* and the curved concave portion 4*e*, the heat dissipation properties thereof can be improved. Further, the heat dissipation properties can be enhanced by facilitating natural convection inside the light source chamber 3*c* within the top cover 4.

Although a case in which ten of the LED optical units 6, 6, . . . are provided is described according to the above embodiment, the present invention is not limited thereto, and the number of LED optical units may be more than ten or less than ten. Further, although the distribution of LED optical units on the left and right of the axis of symmetry O is not limited to five units on each side, a bilaterally symmetrical number thereof arrangement is preferable.

In addition, since each LED optical unit 6 is unitized by integrally assembling the LED module 6*a*, the flat mirrors 6*c* and 6*d*, the side curved mirrors 6*e* and 6*f*, the ceramic substrate 6*b*, the unit support plate 9 and heat sinks 9*c* and 9*c*, and is detachably provided on the top cover 4, each LED optical unit 6 can be individually replaced. Therefore, even if a malfunction occurs in a section of the LED optical unit 6, the costs can be reduced in comparison to replacing the entire lighting apparatus 1. Further, it is possible to easily correspond to various light distribution requirements by changing the shape of the flat mirrors 6*c* and 6*d* or the side curved mirrors 6*e* and 6*f*. Also, since each of the LED optical units 6, 6, . . . includes heat sinks 9*c* and 9*c*, heat dissipation properties with respect to heat generation of the LED module 6*a* can be improved. Furthermore, since the heat sinks 9*e* and 9*c* contact with the inner surface of the top cover 4 in a manner that enables heat transfer therebetween, heat can be dissipated to outside from the top cover 4 and thus the heat dissipation properties can be further enhanced.

Moreover, since the LED module 6*a* is housed inside a housing recess of the ceramic substrate 6*b* having excellent heat transfer properties, the heat dissipation properties with respect to heat generation of the LED module 6*a* can be enhanced. Further, since the ceramic substrate 6*b* that is generally fragile is elastically supported by the pair of plate springs 8*a* and 8*b* without being screwed thereto, damage of the ceramic substrate 6*b* can be reduced. Furthermore, because the light emitting surface 6*aa* of the LED module 6*a* is approximately flush with the front face (surface) of the ceramic substrate 6*b* or is somewhat forward thereof, light emitted from the LED module 6*a* can be reflected by the front face of the white ceramic substrate 6*b* and the side curved mirrors 6*e* and 6*f*, and the reflective efficiency can be improved by that amount.

In addition, as shown in FIG. 4, the outer surface shape of the top cover 4 is formed in a streamline shape that can decrease air resistance with respect to airflows that flow along the outer surface in the width direction and longitudinal direction. Hence, for example, the wind pressure with respect to the lighting apparatus 1 arranged at, for example, a height of ten meters above the ground can be reduced. As a result, the strength of the pole 2 or 2*a* that supports the lighting apparatus 1 as well as the support strength of the embedded foundation thereof can be enhanced. In this connection, one of the lateral hole for pole insertion 3*g* and the vertical hole for pole insertion 3*i* is hermetically sealed by a closure plate when not in use.

Figure 15:
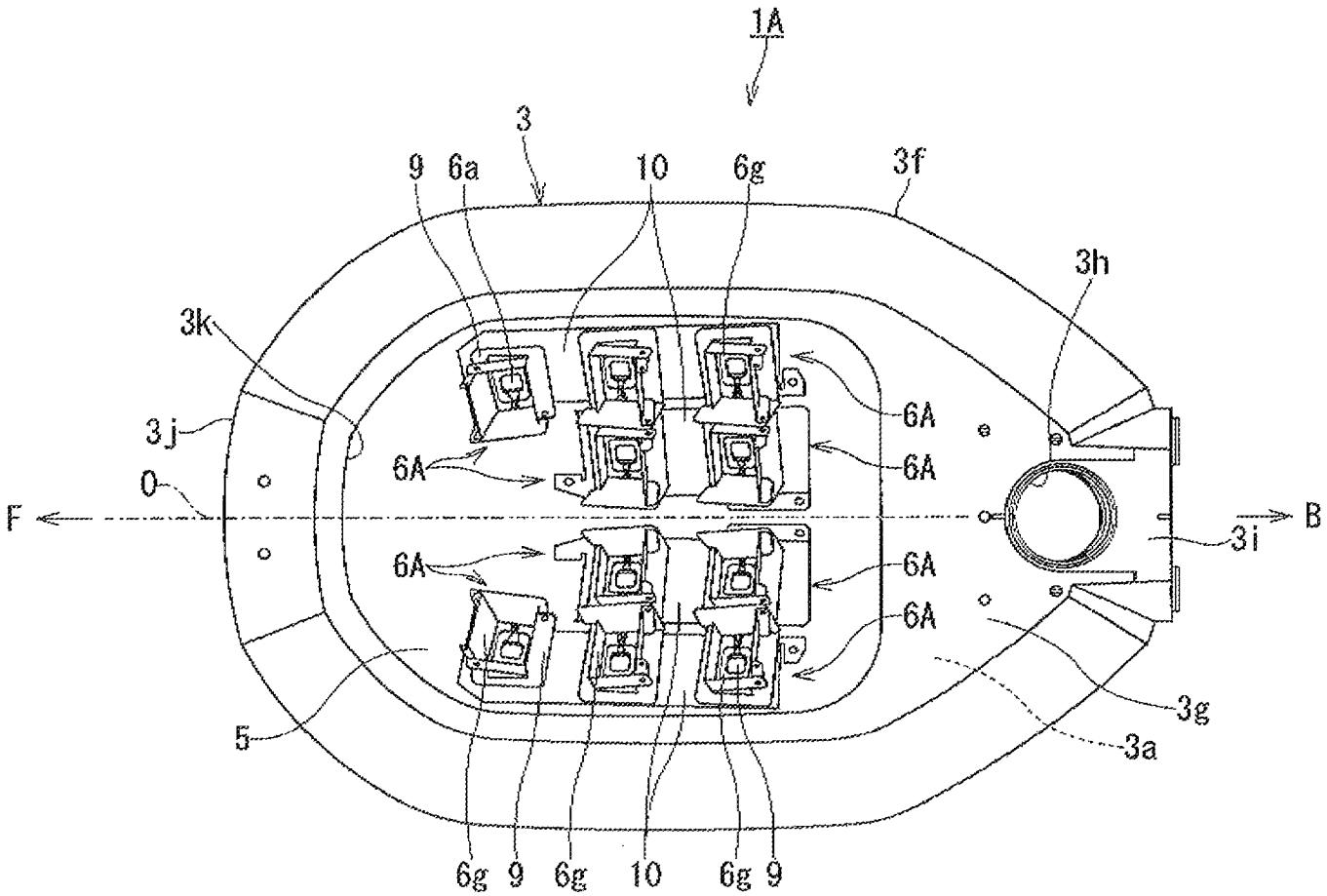
FIG. 15 is a bottom view of a lighting apparatus according to a second embodiment of the present invention.

FIG. 15 is a bottom view of a lighting apparatus 1A according to a second embodiment of the present invention. The lighting apparatus 1A is a road light that is favorably used on a road such as a cross-shaped intersection. The main feature of the lighting apparatus 1A is that the LED optical units 6 according to the lighting apparatus 1 of the first embodiment described above are replaced by LED optical units 6A in the lighting apparatus 1A.

Figure 18:
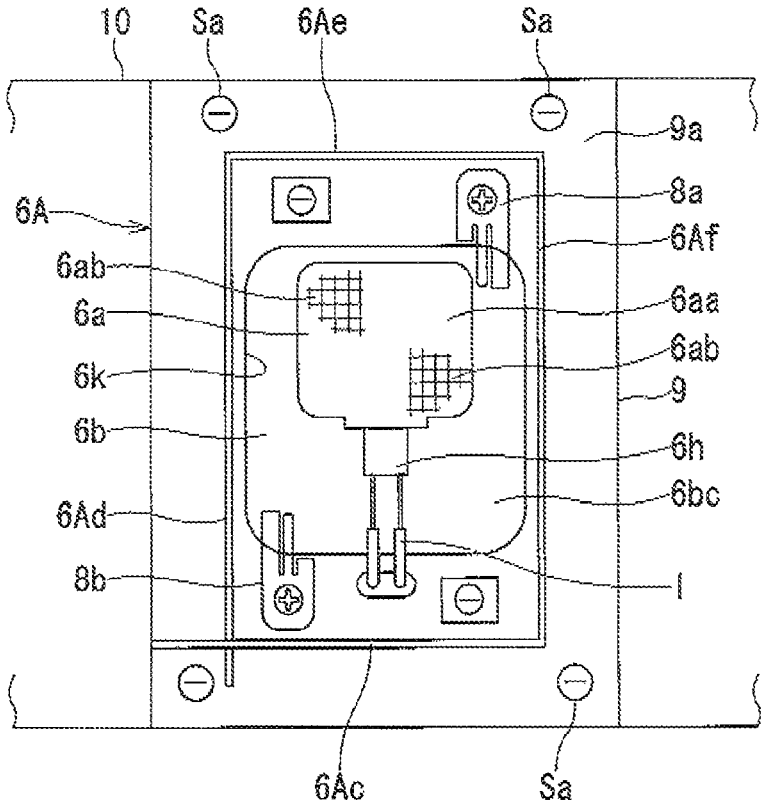
FIG. 18 is a plan view of an LED optical unit shown in FIG. 15 to FIG. 17.
Figure 19:
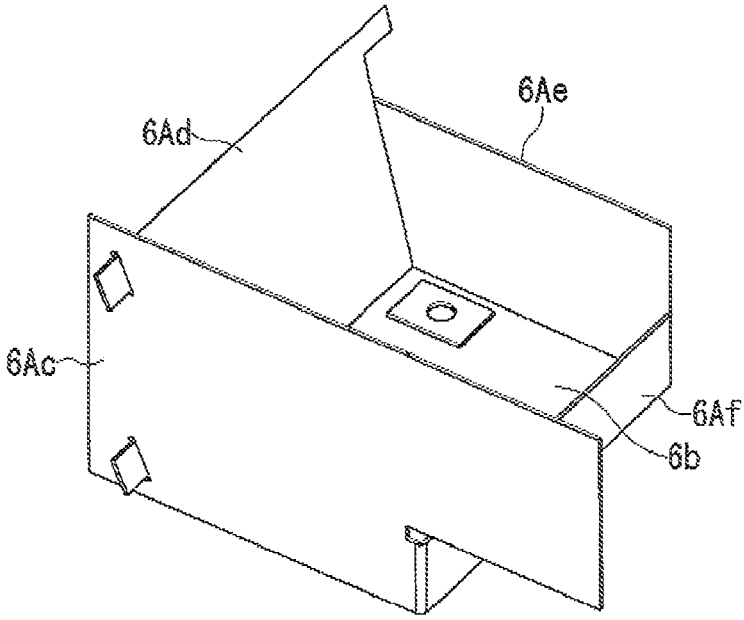
FIG. 19 is a perspective view of a reflector shown in FIG. 15 to FIG. 17.
Figure 21:
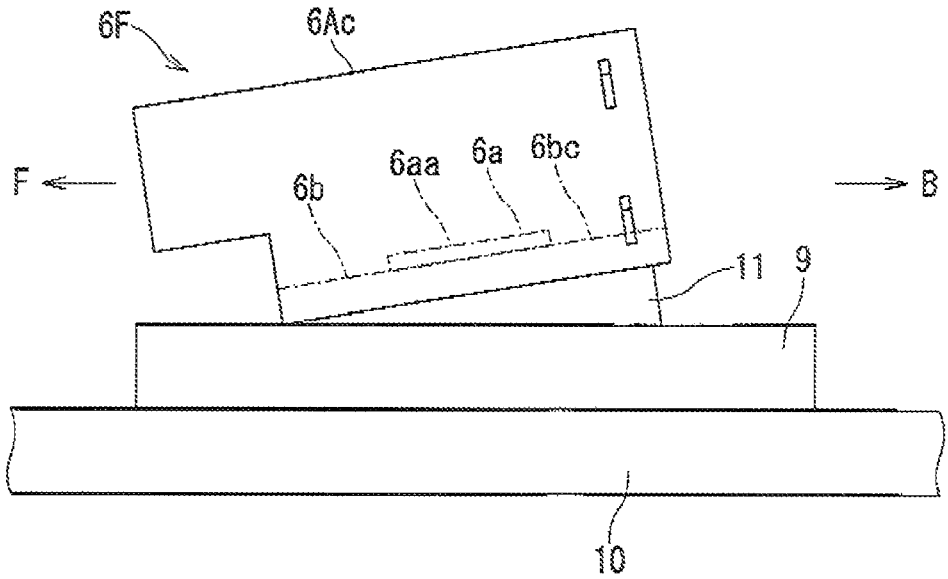
FIG. 21 is a side view of a forward irradiation LED optical unit shown in FIG. 15 to FIG. 17.
Figure 22:
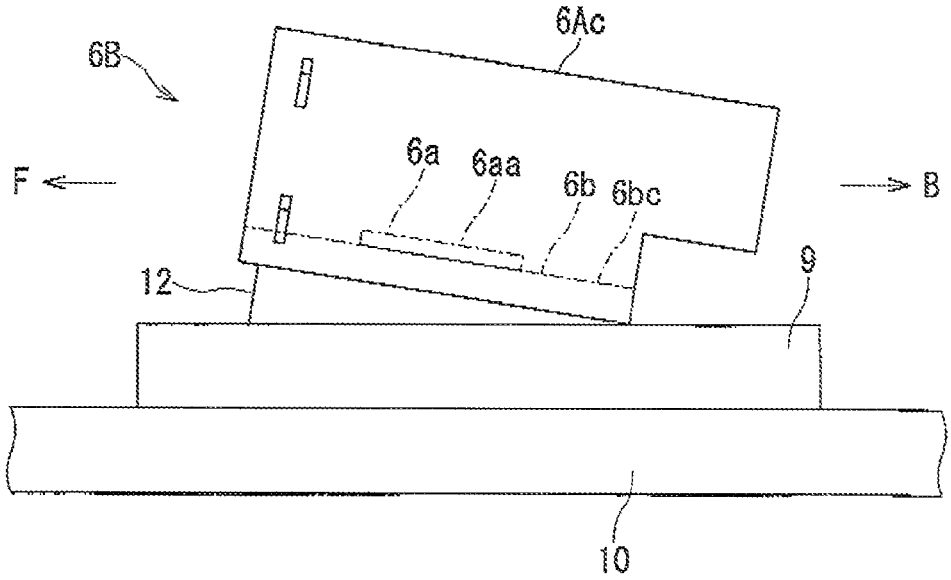
FIG. 22 is a side view of a backward irradiation LED optical unit shown in FIG. 15 to FIG. 17.

Relative to the above described LED optical unit 6, in the LED optical unit 6A the flat mirrors 6*c* and 6*d* and the side curved mirrors 6*e* and 6*f* of the LED optical units 6 are replaced by reflection mirrors 6Ac, 6Ad, 6Ae, and 6Af on four faces as shown in FIG. 19. The LED optical unit 6A also includes a forward irradiation LED optical unit 6F as shown in FIG. 21, and a backward irradiation LED optical unit 6B as shown in FIG. 22. Apart from these main features, the LED optical unit 6A is approximately the same as the above described LED optical unit 6. Hence, in FIG. 15 to FIG. 22, the same or corresponding portions are denoted by like reference numerals, and part of the description thereof is omitted below.

More specifically, as shown in FIG. 15, a plurality of the LED optical units 6A, 6A, . . . are aligned in a plurality of rows, for example, in FIG. 15, four horizontal rows, and housed inside the case main body 3.

A required number, for example, five, of the LED optical units 6A, 6A, . . . are symmetrically arranged on the left and right sides (top and bottom in FIG. 15), respectively, taking the central axis O passing through the center of the four rows in the front-to-rear direction (the left-to-right direction in FIG. 15) of the case main body 3 as an axis of symmetry.

Figure 16:
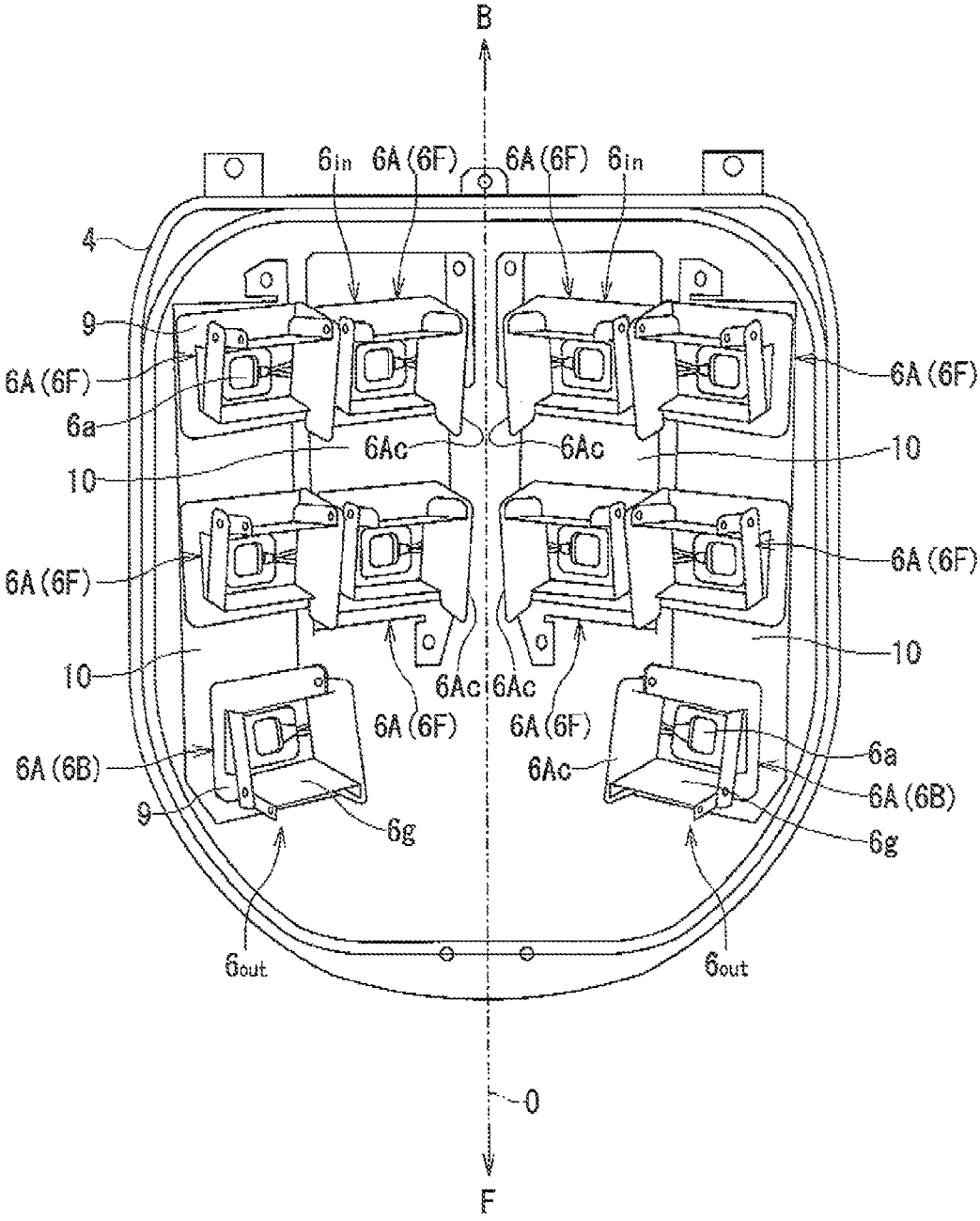
FIG. 16 is a plan view of the inner surface of a top cover of the lighting apparatus shown in FIG. 15.
Figure 17:
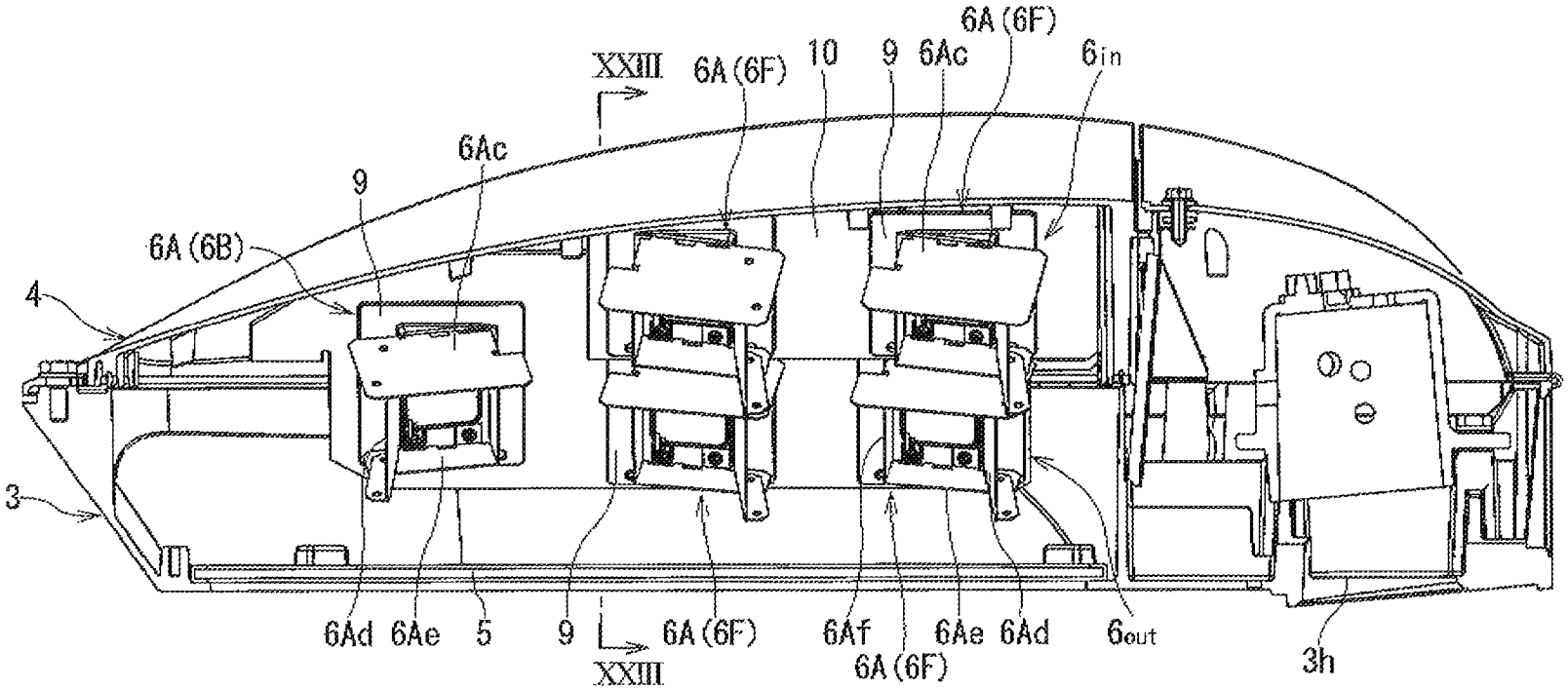
FIG. 17 is a cross-sectional side view of the lighting apparatus shown in FIG. 15.

As shown in FIG. 16, the LED optical units 6A, 6A, . . . on each side are, for example, arranged so that a required number, for example, two, of the LED optical units 6A, 6A, . . . are arranged in parallel in the axial direction of the central axis on an inner side "in" (central axis O side) of the arrangement, and on an outer side "out" thereof, a required number, for example, three, of the LED optical units 6A, 6A, . . . are arranged in parallel in the axial direction of the central axis O. The LED optical units 6A, 6A, . . . arranged on the left and right sides dispose the irradiation openings 6*g* thereof in a crossing manner with respect to each other towards the opposite sides in the left-to-right direction. The lights irradiated from the LED optical units 6A, 6A, . . . are caused to intersect below the LED optical units 6A, 6A, . . . .

Figure 23:
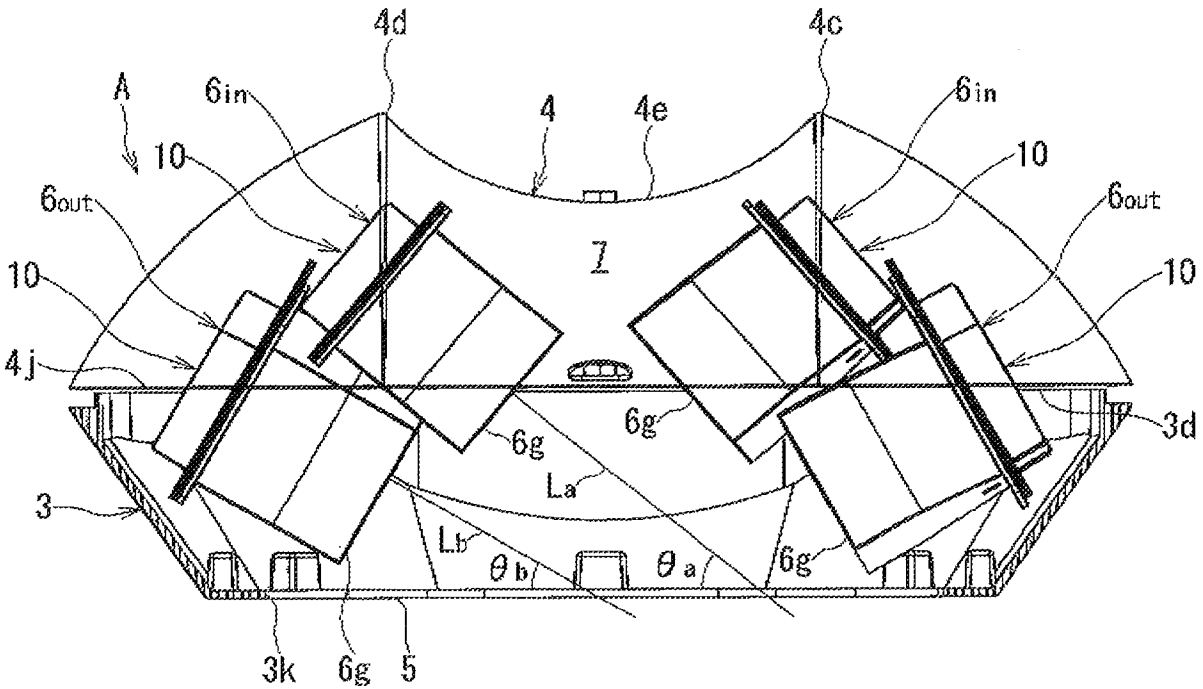
FIG. 23 is a sectional view along a line XXIII-XXIII in FIG. 17.

Further, as shown in FIG. 23, when the top cover 4 and the case main body 3 are joined together, the inner space thereof is formed into a light source housing portion 7 that houses a plurality of the LED optical units 6A, 6A, . . . . Inside the light source housing portion 7, each LED optical unit 6in is disposed above, that is, at a higher position than (upper level), each LED optical unit 6out of the array. The inner side and outer side LED optical units 6in and 6out are aligned in an intersecting truncated chevron shape which is a truncated chevron shape expanding like a folding fan in the downward direction in the drawing. Further, the irradiated lights from the respective LED optical units 6in and 6out of the arrays on inner and outer sides intersect at a position below these LED optical units 6in and 6out in the drawing. In order to irradiate light in the proximity of the lighting apparatus 1A, each LED optical unit 6in is fixed in an inclined state so that a light axis La of the irradiation light thereof is at a required angle θa (for example, 50°) with respect to the upper surface of the translucent plate 5. Further, in order to irradiate light to an area farther away than the proximity of the lighting apparatus 1A, each LED optical unit 6out is fixed in an inclined state so that a light axis Lb of the irradiation light thereof is at a required angle θb (for example, 60°) with respect to the upper surface of the translucent plate 5.

As shown in FIG. 18, in each LED optical unit 6A, an LED module 6*a* as one example of a light emitting module, a ceramic substrate 6*b* as one example of a supporting substrate thereof, and the four sides at the outer circumference of the ceramic substrate 6*b* are surrounded in a rectangular shape by reflection mirrors 6Ac, 6Ad, 6Ae, and 6Af as one example of the reflector. The reflection mirrors 6Ac, 6Ad, 6Ae, and 6Af are formed by an aluminum metal plate or the like. The inner surface of each of the reflection mirrors 6Ac, 6Ad, 6Ae, and 6Af is formed as a reflective surface by subjecting the inner surface to a mirror finishing process.

As shown in FIG. 19, the reflection mirrors 6Ac to 6Af are formed so that the sizes, the shapes and the heights of the reflection mirrors are different to each other, and among the pairs of reflection mirrors that face each other, for example, 6Ac and 6Ae, and 6Ad and 6Af, one reflection mirror is lower than the other. In this example, 6Ae and 6Af are lower than 6Ac and 6Ad, respectively (6Ae<6Ac, 6Af<6Ad). Thus, light that is reflected by the reflection mirrors 6Ac and 6Ad that have the higher heights is not reflected again by the facing reflection mirrors 6Ac and 6Af, respectively and is irradiated upward thereof (light-through) so that the light is irradiated to a farther area.

For this purpose, as shown in FIG. 15 and FIG. 16, in each LED optical unit 6A, the reflection mirror 6Ac with the highest height among the reflection mirrors 6Ac to 6Ad is arranged as a reflective surface position that is approximately parallel to the central axis O (axis of symmetry) and is also located on the central axis O side in each LED optical unit 6A.

Consequently, light can be irradiated further in the outward direction in the left-to-right direction in FIG. 15 and FIG. 16.

As shown in FIG. 18, the LED module 6*a*, for example, comprises a COB (chip on board) type pseudo-white light emitting diode that combines blue and yellow lights. More specifically, with respect to the LED module 6*a*, for example, a required number (for example, 196) of LED (light emitting diode) bare chips that emit blue light are arrayed using a matrix of a required number of rows (for example, 14 rows by 14 rows) and directly mounted on a printed circuit board on which a circuit is formed. Subsequently, a resin containing phosphors that emit yellow light is applied onto the LED bare chips, the resulting structure is sealed by means of a silicone resin, and then adhered, for example, by means of a silicone resin on a substrate.

The LED module 6*a* is adhered by means of a silicone resin as an adhesive to the front face 6*bc* of the ceramic substrate 6*b* in a state in which the light emitting surface 6*aa* thereof is caused to protrude somewhat more frontward than the front face 6*bc* of the ceramic substrate 6*b* to be exposed to outside. The light emitting surface 6*aa* of the LED module 6*a* is configured to be at a position that protrudes somewhat more frontward than the front surface 6*bc* of the white ceramic substrate 6*b* in this fixed state.

As shown in FIG. 18, in the LED optical unit 6A, the LED module 6*a* is arranged in an eccentric manner towards the low reflection mirror 6Ae that faces the reflection mirror 6Ac having the highest height. More specifically, the LED module 6*a* as the light source is arranged away from the highest reflection mirror 6Ac that can irradiate reflected light farther than the low reflection mirror 6Ae, which is possible to make the angle of incidence at the reflection mirror 6Ac smaller than at the reflection mirror 6Ae that is close to the LED module 6*a*. Hence the irradiation distance of reflected light from the reflection mirror 6Ac can be extended.

Figure 20:
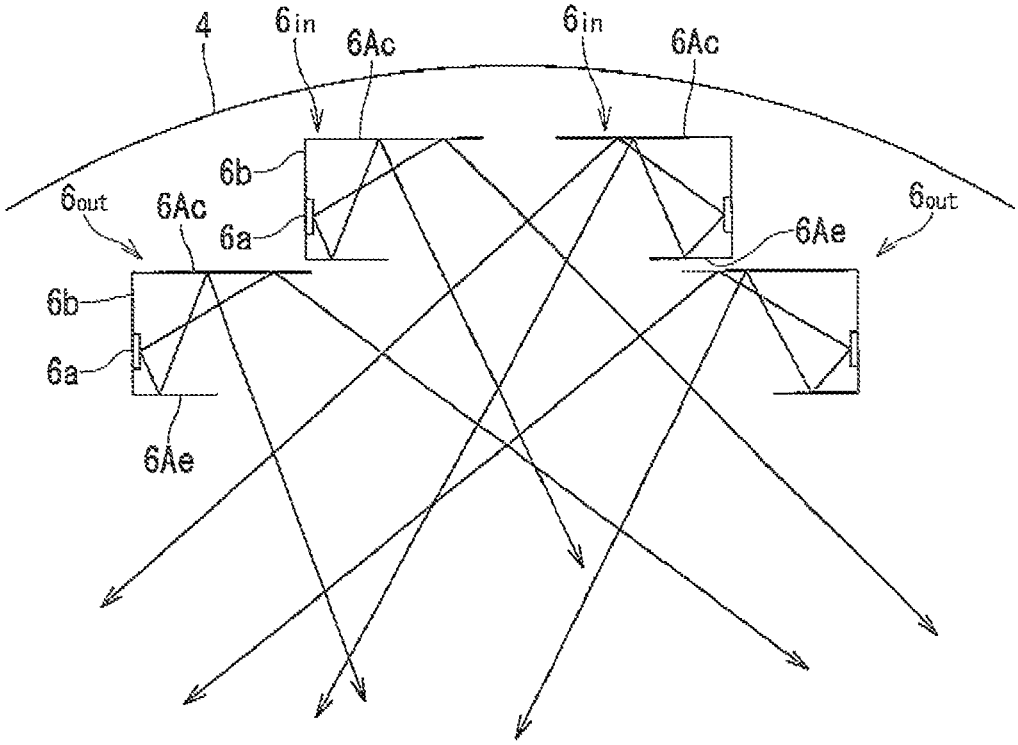
FIG. 20 is a schematic diagram that illustrates a reflection action of an optical unit shown in FIG. 15 to FIG. 17.

FIG. 20 is a schematic diagram that illustrates the reflection action of the reflection mirror 6Ac with a high height and the reflection mirror 6Ae with a lower height than the reflection mirror 6Ac. As shown in FIG. 20, when light of the LED module 6*a* is reflected by the reflection mirror 6Ae with a low height, the reflected light is reflected again by the reflection mirror 6Ac with a high height facing the reflection mirror 6Ae. The reflected light is irradiated to the proximity of the relatively inner side in the width direction (the left-to-right direction in FIG. 20) of the top cover 4. Depending on this proximate irradiation, the luminous flux decreases somewhat due to reflection loss because the light emitted from the LED module 6*a* is reflected twice, namely, at the low reflection mirror 6Ae and at the high reflection mirror 6Ac. However, since the light is irradiated in the proximity of the lighting apparatus 1A, the light intensity is sufficient for the proximate irradiation.

In contrast, when light from the LED module 6*a* is reflected at the reflection mirror 6Ac with a high height, because the high reflection mirror 6Ac is at a farther distance from the LED module 6*a* than the reflection mirror 6Ae, the angle of incidence of light incident on the high reflection mirror 6Ac decreases by a corresponding amount. Consequently, the light is reflected at a small reflection angle by the reflection mirror 6Ac and is irradiated to a distant area outside the width direction of the top cover 4. In this case, since the light is reflected only once at the reflection mirror 6Ac, the luminous flux generated by the reflection is stronger than the proximate irradiation by a corresponding amount, and thus the reflected light can be irradiated a correspondingly farther distance.

The plurality of LED optical units 6A are symmetrically arranged on the left and right with respect to a central axis in the width direction of the top cover 4. Hence, the uniformity ratio of illuminance on a horizontal plane directly under the top cover 4 in FIG. 20 can be improved.

Further, the plurality of LED optical units 6A arranged on one side, respectively, with respect to the central axis in the width direction of the top cover 4 are arranged on two upper and lower levels, and there is a difference in level between adjacent LED optical units 6A in the width direction of the top cover 4. Hence, it is possible to prevent or lessen the occurrence of a shadow caused by light irradiated from the LED optical units 6A being blocked by the other LED optical unit 6A.

Although the present schematic diagram illustrates the reflection actions of the reflection mirrors 6Ac and 6Ae, the reflection mirrors 6Ad and 6Af of the LED optical unit 6A can likewise perform backward (distant) irradiation and backward (proximate) irradiation by means of reflection mirrors of different heights.

As shown in FIG. 18, the fitting opening portion 6*k* is formed on the front face 9*a* of the unit support plate 9 that is formed in the shape of a metal rectangular flat plate made of aluminum or the like. In a state in which the back surface of the ceramic substrate 6*b* is arranged inside the fitting opening portion 6*k*, the front face of the ceramic substrate 6*b* is elastically supported by the upper and lower pair of plate springs 8*a* and 8*b* as an example of a pressing member screwed into the unit support plate 9. More specifically, the ceramic substrate 6*b* is elastically sandwiched in the thickness direction by the upper and lower pair of plate springs 8*a* and 8*b* and the unit support plate 9.

The upper ends and lower ends of the plate springs 8*a* and 8*b* are fixed by screwing to the upper and lower ends of the unit support plate 9, respectively. A plurality of the LED optical units 6A are detachably attached by bolts or screws Sa or the like to a unit mounting plate 10 formed in a band-plate shape. On the unit mounting plates 10, for example, two of the second inner side LED optical units 6Ain (upper level) are arranged side by side and, for example, three of the outer side LED optical units 6Aout (lower level) are arranged side by side. The unit mounting plates 10 are fixed at required places to the inner surface of the top cover 4 by being firmly adhered by screwing to a mounting boss that is integrally provided in a protruding condition on the inner surface of the top cover 4. More specifically, all of the LED optical units 6A, 6A, . . . are detachably fixed to the inner surface of the top cover 4. At the time of fixing, at least one part of the unit support plate 9 is brought in contact directly with the inner surface of the top cover 4 or is brought in contact with the inner surface of the top cover 4 through a heat dissipating body such as a metal plate with excellent heat dissipation properties or a heat pipe to thereby enhance the heat dissipation properties of the lighting apparatus 1A.

A plurality of power source systems, for example, two systems, are provided as the power source systems of the LED optical units 6A, 6A, . . . . More specifically, a plurality of power source systems may be respectively provided for the left and right sides of the lighting of the LED optical units 6A, 6A, . . . when taking the central axis O as an axis of symmetry. Accordingly, even if there is a malfunction in one of the systems, as long as there is not a malfunction in the other system it is possible to light the other LED optical units 6A, 6A, . . . on the left and right, and thus a situation in which all of the LED optical units 6A, 6A, . . . do not emit light can be prevented.

The LED optical units 6A include a forward irradiation LED optical unit 6F shown in FIG. 21 and a backward irradiation LED optical unit 6B shown in FIG. 22. As shown in FIG. 21, the forward irradiation LED optical unit 6F includes a wedge-shaped forward spacer 11 that causes a light emitting surface 6*aa* of the LED module 6*a* and a front face 6*bc* of the ceramic substrate 6*b* to incline in a forward direction F side, that is, towards the opposite side of the pole 2 as the support column. Preferably, the spacer 11 is made of a material that has excellent heat dissipation properties such as die-cast aluminum.

As shown in FIG. 16, the forward irradiation LED optical units 6F are arranged on the two upper and lower (inner and outer sides) levels at a rear portion of the case main body 3. Four left and right pairs of the forward irradiation LED optical units 6F, that is, a total of eight units 6F, are arranged thereon.

In contrast, as shown in FIG. 22, the backward irradiation LED optical unit 6B includes a wedge-shaped backward spacer 12 that made of die-cast aluminum metal or the like that causes the light emitting surface 6*aa* of the LED module 6*a* and the front face 6*bc* of the ceramic substrate 6*b* to incline in a backward direction B. As shown in FIG. 16, the backward irradiation LED optical units 6B are arranged in left and right pairs at a front portion.

Figure 24:
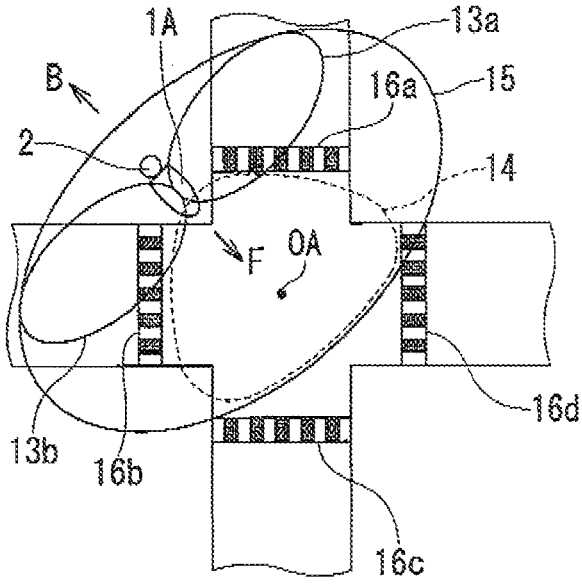
FIG. 24 is a view that illustrates light distribution characteristics when a single lighting apparatus shown in FIG. 15 to FIG. 22 is erected on the outer side of one corner of a cross-shaped intersection of a road.

FIG. 24 illustrates light distribution characteristics when a single lighting apparatus 1A according to the second embodiment is, or example, erected on an outer side at a corner of a cross-shaped intersection of a road. The lighting apparatus 1A is erected so that the head thereof faces a center point OA of the road intersection.

The light distribution of the lighting apparatus 1A includes left and right backward light distributions 13*a* and 13*b* and a forward light distribution 14. The left and right backward light distributions 13*a* and 13*b* are formed when light is irradiated in both the left and right directions in a backward direction B, respectively, by two backward irradiation LED optical units 6B and 6B on the left and right arranged at the front portion of the case main body 3. The forward light distribution 14 is formed when light is irradiated in a forward direction F by a total of eight forward irradiation LED optical units 6F, 6F, . . . that comprise four left and right pairs arranged at the rear portion of the case main body 3.

Accordingly, the light distribution of the lighting apparatus 1A is an approximately elliptic-shaped combined light distribution 15 which combines the approximately triangular forward light distribution 14 and the backward light distributions 13*a* and 13*b*. The combined light distribution 15 can illuminate the roads at the intersection at which the lighting apparatus 1A is erected in an approximately elliptical shape centered on one corner. The combined light distribution 15 can also illuminate the intersection center OA and an area including two pedestrian crossings 16*a* and 16*b* at which the lighting apparatus 1A is installed.

Figure 25:
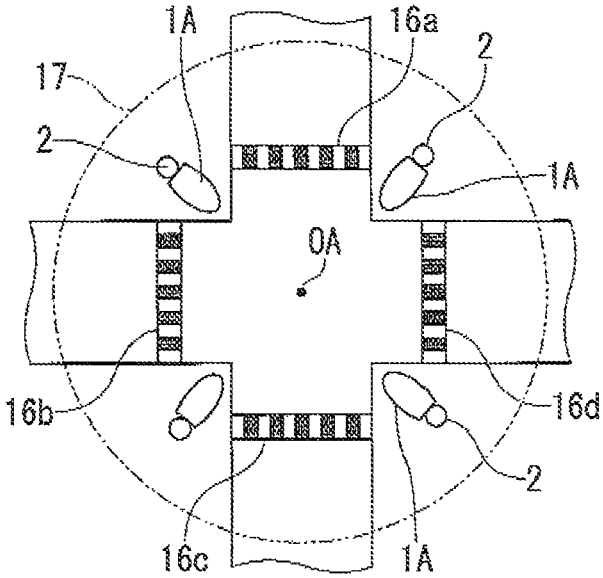
FIG. 25 is a view that illustrates combined light distribution characteristics when four of the lighting apparatuses shown in FIG. 15 to FIG. 22 are erected at a cross-shaped intersection of a road.

FIG. 25 shows a combined light distribution 17 when four of the lighting apparatuses 1A, 1A, . . . are erected at the corners of the intersection. The combined light distribution 17 can illuminate an area within a radius including a region somewhat to the back of the four lighting apparatuses 1A, 1A, . . . from the intersection center OA, and all of four pedestrian crossings 16*a* to 16*d* of the intersection can be illuminated.

Although several embodiments of the present invention have been described above, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A lighting apparatus, comprising:

an optical unit including a light emitting module that includes a light emitting element, a supporting substrate that supports the light emitting module, a heat sink, and a unit supporting member including a first surface to which the supporting substrate is attached and a second surface to which the heat sink is attached;

a mounting plate configured to mount the optical unit such that the light emitting module is positioned in front of the mounting plate and the heat sink is positioned behind the mounting plate; and a body configured to house the mounting plate mounting the optical unit and configured to be thermally connected to the mounting plate.

2. The lighting apparatus according to claim 1, wherein the supporting substrate is made of a ceramic material and is sandwiched between a pressing member and the unit supporting member, the pressing member elastically pressing a surface of the supporting substrate.

3. The lighting apparatus according to claim 1, further comprising a reflector that controls distribution of light from the light emitting module and comprises a plurality of reflecting surfaces, the plurality of reflecting surfaces arranged to surround the light emitting module, wherein each one of the plurality of the reflecting surfaces has a height different from the height of each other one of the plurality of the reflecting surfaces, and the light emitting module is disposed at a position such that a distance to the position from a highest one of the plurality of reflecting surfaces is farther than each distance to the position from each one of the other reflecting surfaces.

4. The lighting apparatus according to claim 1, further comprising a reflector that controls distribution of light from the light emitting module.

* * * * *